US011021282B2

(12) United States Patent
Elliott

(10) Patent No.: US 11,021,282 B2
(45) Date of Patent: Jun. 1, 2021

(54) STRAPPING DEVICE CONFIGURED TO CARRY OUT A STRAP-ATTACHMENT CHECK CYCLE

(71) Applicant: Signode Industrial Group LLC, Glenview, IL (US)

(72) Inventor: Dustin D. Elliott, Grayslake, IL (US)

(73) Assignee: Signode Industrial Group LLC, Glenview, IL (US)

( * ) Notice: Subject to any disclaimer, the term of this patent is extended or adjusted under 35 U.S.C. 154(b) by 221 days.

(21) Appl. No.: 16/011,839

(22) Filed: Jun. 19, 2018

(65) Prior Publication Data

US 2019/0023431 A1 Jan. 24, 2019

Related U.S. Application Data

(60) Provisional application No. 62/534,502, filed on Jul. 19, 2017.

(51) Int. Cl.
*B65B 13/22* (2006.01)
*B65B 13/18* (2006.01)
(Continued)

(52) U.S. Cl.
CPC ..... *B65B 13/22* (2013.01); *B65B 13/18* (2013.01); *B65B 13/32* (2013.01); *B65B 57/00* (2013.01);
(Continued)

(58) Field of Classification Search
CPC ..... B65B 13/22; B65B 13/18; B65B 13/32; B65B 13/06; B65B 13/185; B65B 57/18; B65B 57/02; B65B 57/00
(Continued)

(56) References Cited

U.S. PATENT DOCUMENTS 3,720,158 A 3/1973 Sauer et al.
4,836,873 A * 6/1989 Mitanihara ..... B65B 13/06 156/157
(Continued)

FOREIGN PATENT DOCUMENTS

EP 1 394 041 A1 3/2004
JP H04 44922 A 2/1992
JP 2003 072708 A 3/2003

OTHER PUBLICATIONS

European Patent Office acting as International Searching Authority, International Search Report and Written Opinion in corresponding application No. PCT/US2018/038480, dated Sep. 20, 2018 (11 pages).
(Continued)

*Primary Examiner* — Adam J Eiseman
*Assistant Examiner* — Mohammed S. Alawadi
(74) *Attorney, Agent, or Firm* — Neal, Gerber & Eisenberg LLP

(57) ABSTRACT

Various embodiments of the present disclosure provide a strapping device configured to carry out a strap-attachment check cycle. After attaching leading and trailing strap ends of a strap to one another to form a tensioned loop of strap around a load, the strapping device is configured to carry out the strap-attachment cycle to test the strength of the attachment between the leading and trailing strap ends and to provide feedback as to whether the strap attachment is satisfactory.

14 Claims, 36 Drawing Sheets

(51) Int. Cl.

| | |
|---|---|
| ***B65B 57/18*** | (2006.01) |
| ***B65B 57/02*** | (2006.01) |
| ***B65B 57/00*** | (2006.01) |
| ***B65B 13/32*** | (2006.01) |
| ***B65B 13/06*** | (2006.01) |

(52) U.S. Cl.
CPC ..... *B65B 57/02* (2013.01); *B65B 57/18* (2013.01); *B65B 13/06* (2013.01)

(58) Field of Classification Search
USPC ..... 100/2
See application file for complete search history.

(56) References Cited

U.S. PATENT DOCUMENTS

| | | | | |
|---|---|---|---|---|
| 4,850,179 | A | 7/1989 | Takami | |
| 5,722,214 | A | 3/1998 | Spatafora | |
| 5,894,789 | A | 4/1999 | Huber | |
| 6,038,967 | A | 3/2000 | Chak et al. | |
| 6,571,531 | B2 | 6/2003 | Kasel | |
| 8,701,555 | B2 | 4/2014 | Bell, Jr. | |
| 9,061,779 | B2 * | 6/2015 | Elliott | B65B 13/32 |

OTHER PUBLICATIONS

"Communication pursuant to Article 94(3) EPC", corresponding European Patent Application No. EP 18 740 035.3 (5 pages), dated Jan. 28, 2021.

* cited by examiner

STRAPPING DEVICE CONFIGURED TO CARRY OUT A STRAP-ATTACHMENT CHECK CYCLE

PRIORITY

This application claims priority to and the benefit of U.S. Provisional Patent Application No. 62/534,502, filed Jul. 19, 2017, the entire contents of which are incorporated herein by reference.

FIELD

The present disclosure relates to strapping devices for securing loops of strap around loads. More specifically, the present disclosure relates to strapping devices configured to carry out a strap-attachment check cycle.

BACKGROUND

A strapping device forms a tensioned loop of steel or plastic strap (sometimes referred to as a "strap loop") around a load. Standalone strapping machines (which can be automatic or semiautomatic) and handheld strapping tools are two types of strapping devices. A typical automatic strapping machine is electrically powered and (generally) configured to: draw strap from a strap supply, feed the strap (leading strap end first) around the load, tension the strap, cut the strap from the strap supply to form a trailing strap end, and attach the leading and trailing strap ends to one another to form the strap loop around the load. A typical semiautomatic strapping machine is configured in a similar matter, except the operator draws strap from the strap supply and feeds it around the load. A typical strapping tool is electrically, pneumatically, or manually powered and (generally) configured to, after the operator has encircled the load with strap drawn (leading strap end first) from the strap supply: tension the strap, cut the strap from the strap supply to form a trailing strap end, and attach the leading and trailing strap ends to one another to form the strap loop around the load.

The manner of attaching the leading and trailing strap ends to one another depends on the type of strapping device and the type of strap. Certain known strapping devices configured for plastic strap (such as polyester or polypropylene strap) can include sealing assemblies with friction welders, heated blades, or ultrasonic welders configured to attach the leading and trailing strap ends to one another. Some strapping devices configured for steel strap include sealing assemblies with jaws that mechanically crimp a seal element around the leading and trailing strap ends to attach them to one another. Other strapping devices configured for steel strap include sealing assemblies with punches and dies configured to form a set of mechanically interlocking cuts in the leading and trailing strap ends to attach them to one another (referred to in the strapping industry as a "sealless" attachment). Still other strapping devices configured for steel strap include sealing assemblies with spot or inert-gas welders configured to weld the leading and trailing strap ends to one another.

SUMMARY

Various embodiments of the present disclosure provide a strapping device configured to carry out a strap-attachment check cycle. After attaching leading and trailing strap ends of a strap to one another to form a tensioned loop of strap around a load, the strapping device is configured to carry out the strap-attachment cycle to test the strength of the attachment between the leading and trailing strap ends and to provide feedback as to whether the strap attachment is satisfactory.

In various embodiments, the present disclosure provides a strapping device including a sealing assembly and a controller configured to: cause the sealing assembly to attach a leading strap end of a strap and a trailing strap end of the strap to one another at an attachment area, and cause a first gripper to grip a first portion of the strap and impose a force on a second portion of the strap in a direction away from the first portion of the strap, wherein the first and second portions of the strap are on opposite sides of the attachment area. In various embodiments, the controller is further configured to determine whether a strap-attachment condition is satisfied. In various embodiments, the strapping device further includes an output device, and the controller is further configured to control the output device to output an indication responsive to determining that the strap-attachment condition is not satisfied.

In various embodiments, the present disclosure provides a method of operating a strapping device, the method including attaching, by a sealing assembly, a leading strap end of a strap and a trailing strap end of the strap to one another at an attachment area, gripping, by a first gripper, a first portion of the strap, and afterwards, imposing, by the first gripper, a force on a second portion of the strap in a direction away from the first portion of the strap, wherein the first and second portions of the strap are on opposite sides of the attachment area. In various embodiments, the method includes determining whether a strap-attachment condition is satisfied. In various embodiments, the method further includes responsive to determining that the strap-attachment condition is not satisfied, causing an output device to output an indication.

The strap-attachment check cycle improves upon existing strapping devices by identifying potentially problematic low-strength strap attachments before the load leaves the strapping area. This enables operators to immediately remove the potentially problematic strap loop and to operate the strapping device to re-strap the load. This reduces the occurrence of strap loop failures after the load leaves the strapping device, such as during transport or while in storage at a customer facility.

DETAILED DESCRIPTION

Figure 1:
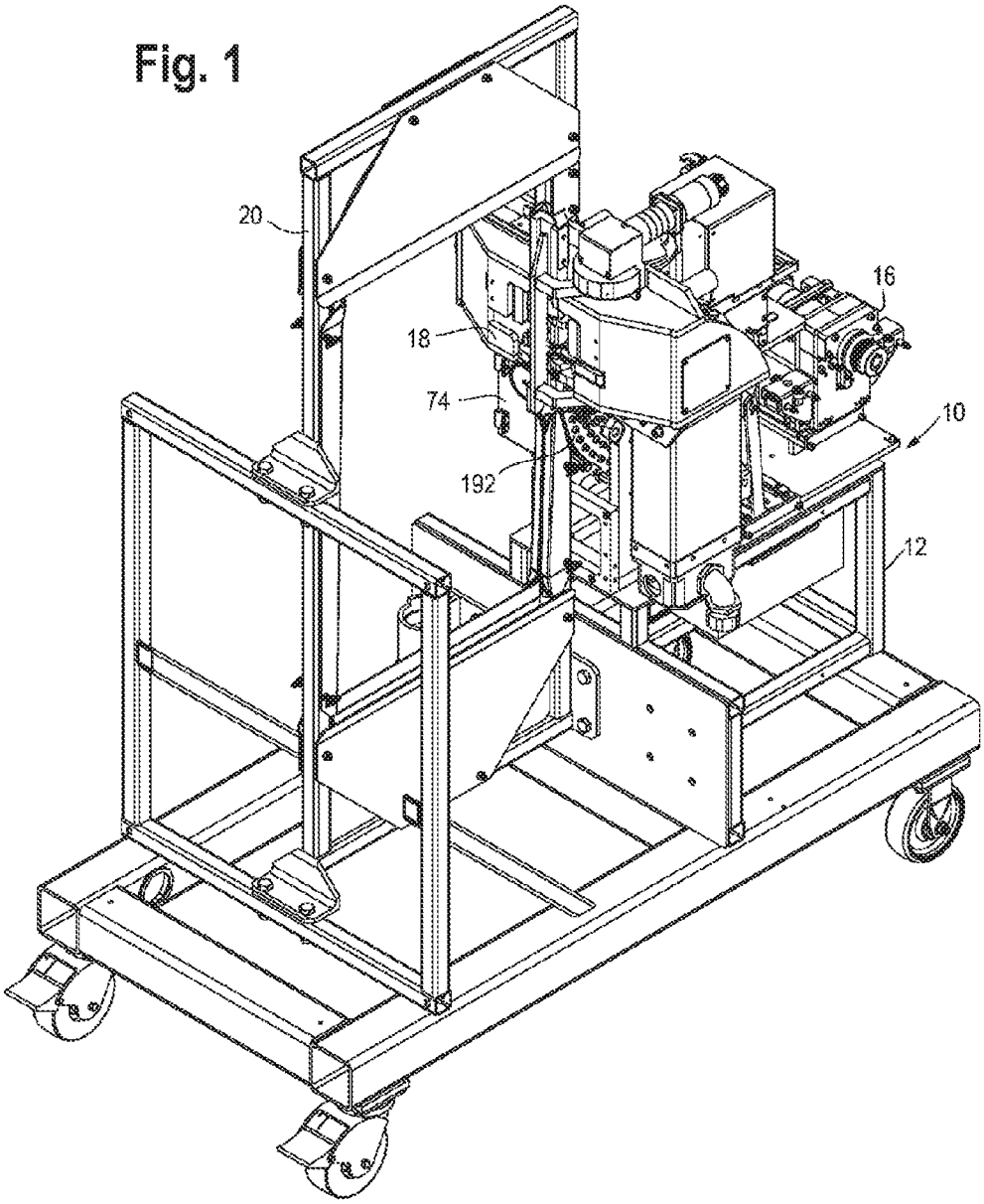
FIG. 1 is a perspective view of one example embodiment of an example strapping machine configured to carry out an example of the strap-attachment check cycle of the present disclosure.

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, connected, etc., are not intended to be limited to direct mounting methods but should be interpreted broadly to include indirect and operably mounted, connected, and like mounting methods. This specification is intended to be taken as a whole and interpreted in accordance with the principles of the present disclosure and as understood by one of ordinary skill in the art.

Various embodiments of the present disclosure provide a strapping device configured to carry out a strap-attachment check cycle. After attaching leading and trailing strap ends of a strap to one another to form a tensioned loop of strap around a load, the strapping device is configured to carry out the strap-attachment cycle to test the strength of the attachment between the leading and trailing strap ends and to provide feedback as to whether the strap attachment is satisfactory. FIGS. 1-40 show and the Detailed Description describes one example strapping device in the form of a strapping machine 10 and its method of carrying out a strapping cycle that includes one example of the strap-attachment cycle. The strapping machine 10 is configured to attach the leading and trailing strap ends of steel strap to one another via an end-to-end weld. This is merely one non-limiting example embodiment of the strapping device of the present disclosure and one non-limiting example embodiment of the strap-attachment cycle of the present disclosure. The strap-attachment check cycle may be employed by any suitable strapping machine, strapping tool, or other strapping device configured for use with strap of any suitable material (such as plastic or steel).

As explained above in the Background, there are several different ways of attaching the leading and trailing strap ends to one another. As used herein, "attaching the leading and trailing strap ends" is meant to encompass all manners of attaching the leading and trailing strap ends to one another. Additionally, as used herein, "strap attachment" is meant to encompass all suitable types of attachment of the leading and trailing strap ends to one another.

Figure 2:
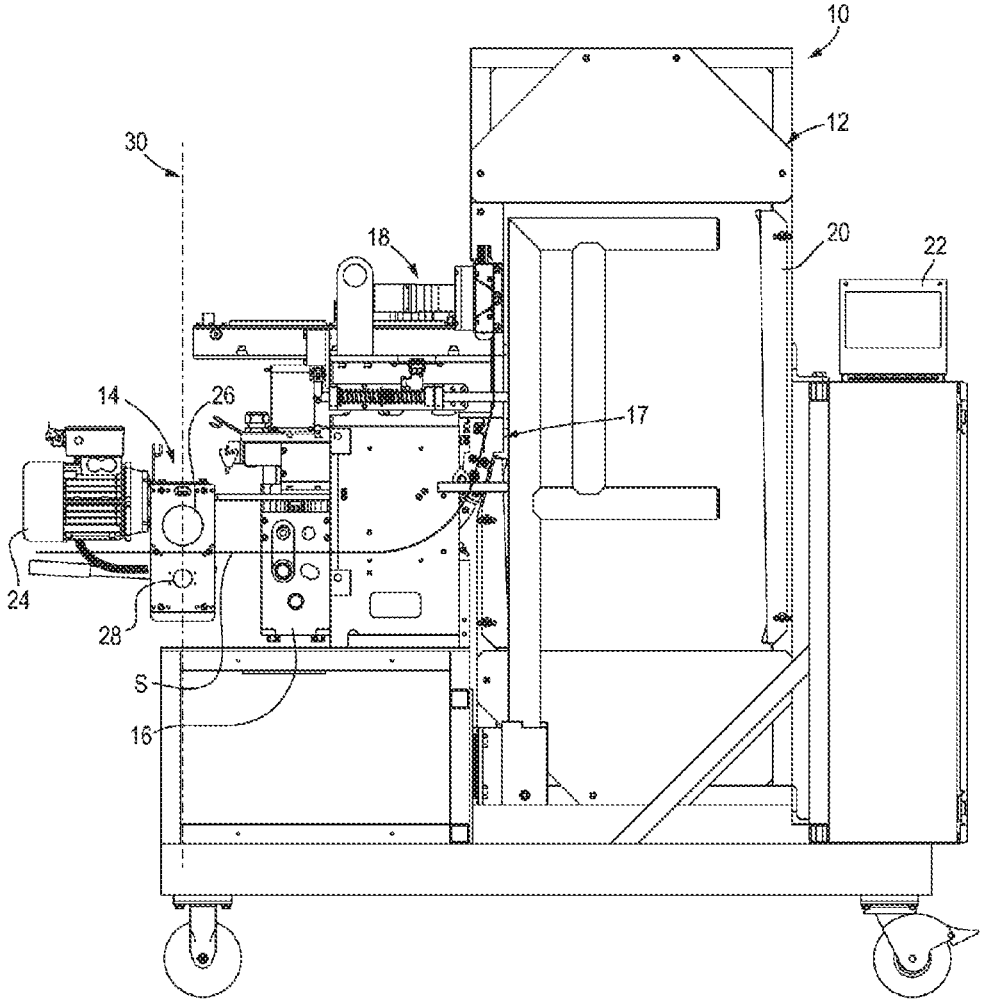
FIG. 2 is a front view of the strapping machine of FIG. 1.
Figure 3:
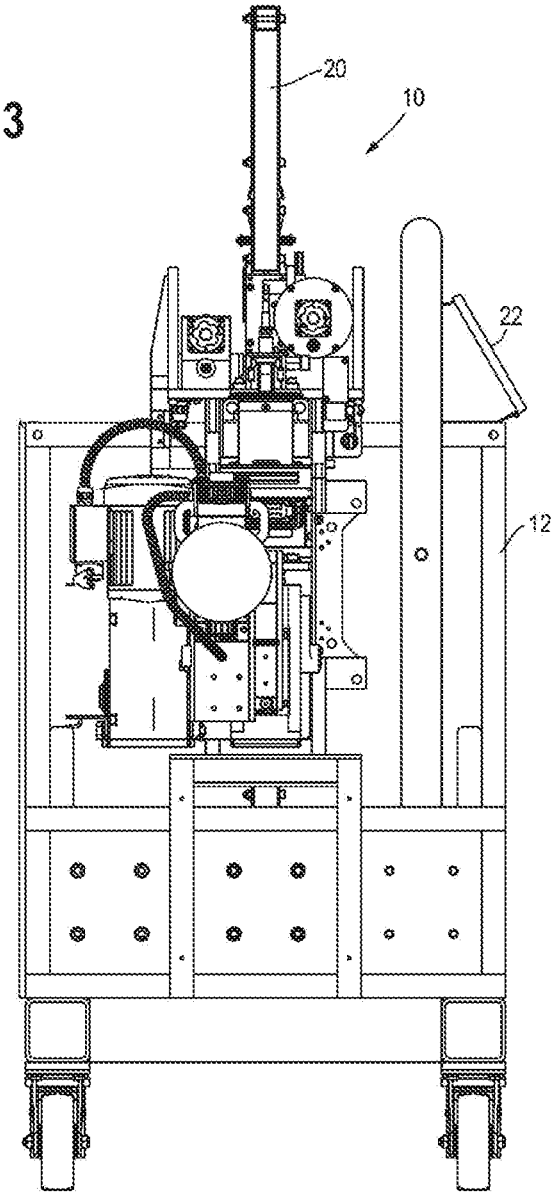
FIG. 3 is a side view of the strapping machine of FIG. 1.
Figure 5:
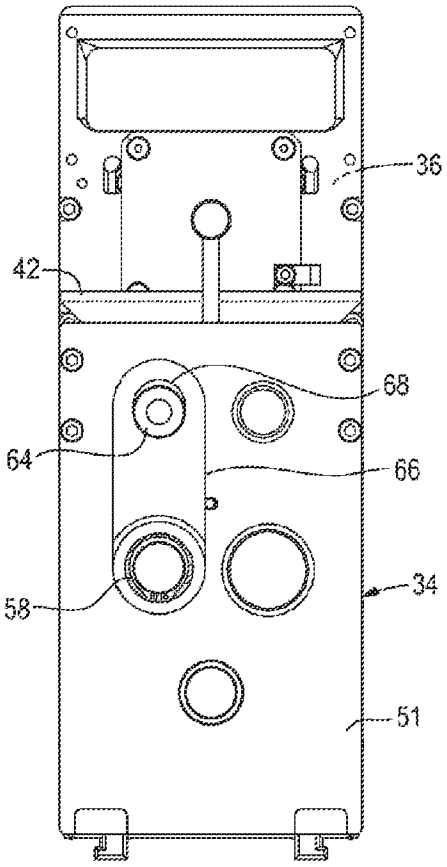
FIG. 5 is a front view of the tension assembly of FIG. 4.
Figure 4:
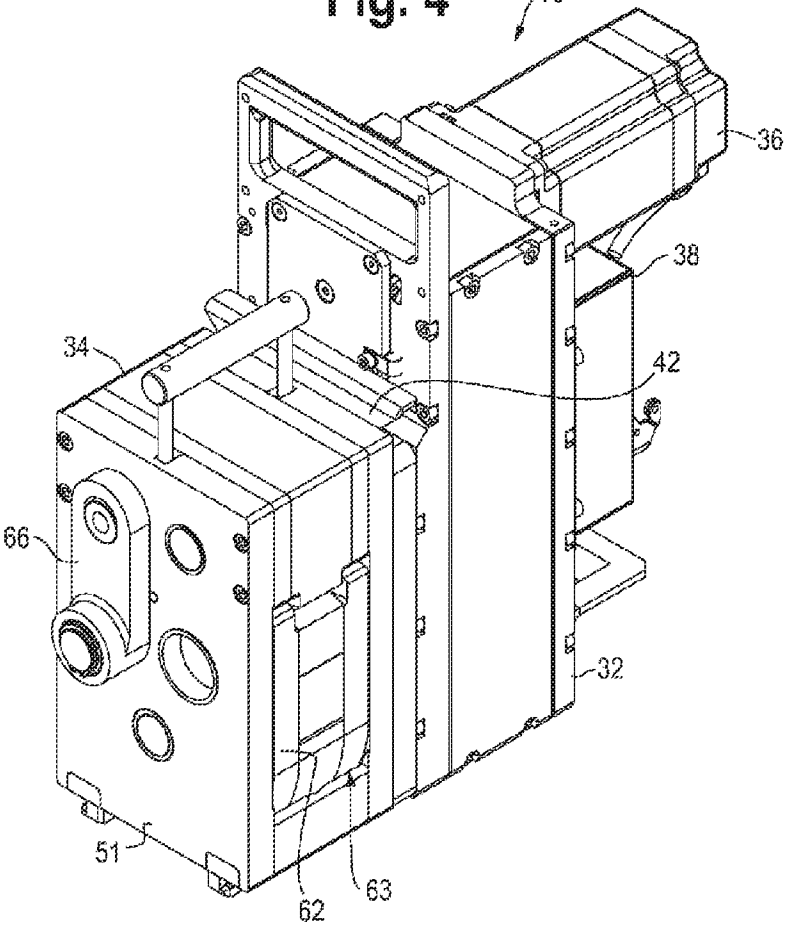
FIG. 4 is a perspective view of a tension assembly of the strapping machine of FIG. 1.
Figure 7:
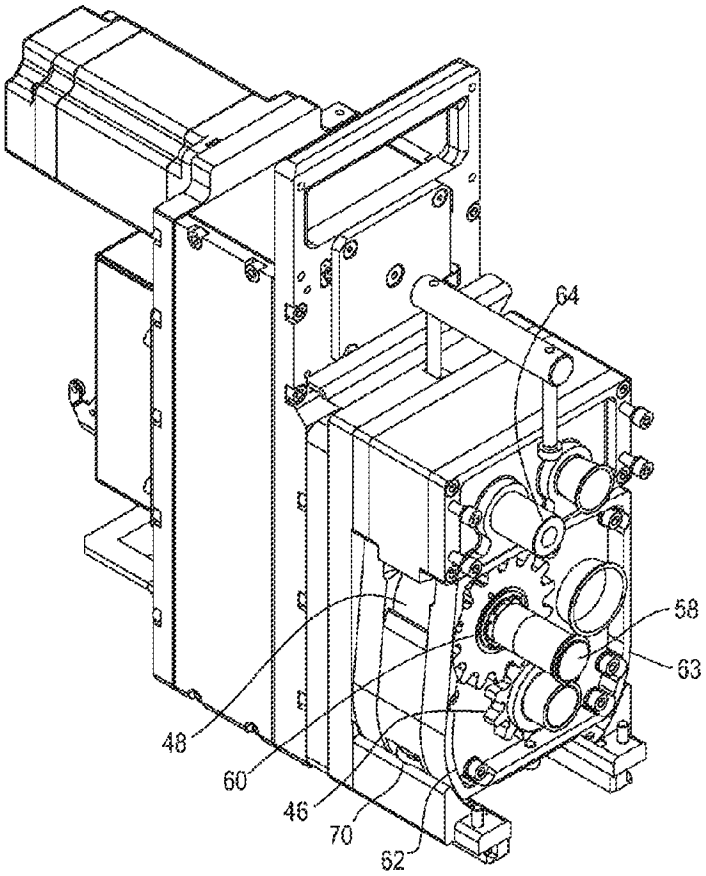
FIG. 7 is a front view of the tension assembly of FIG. 4 with the cover plate removed.
Figure 6:
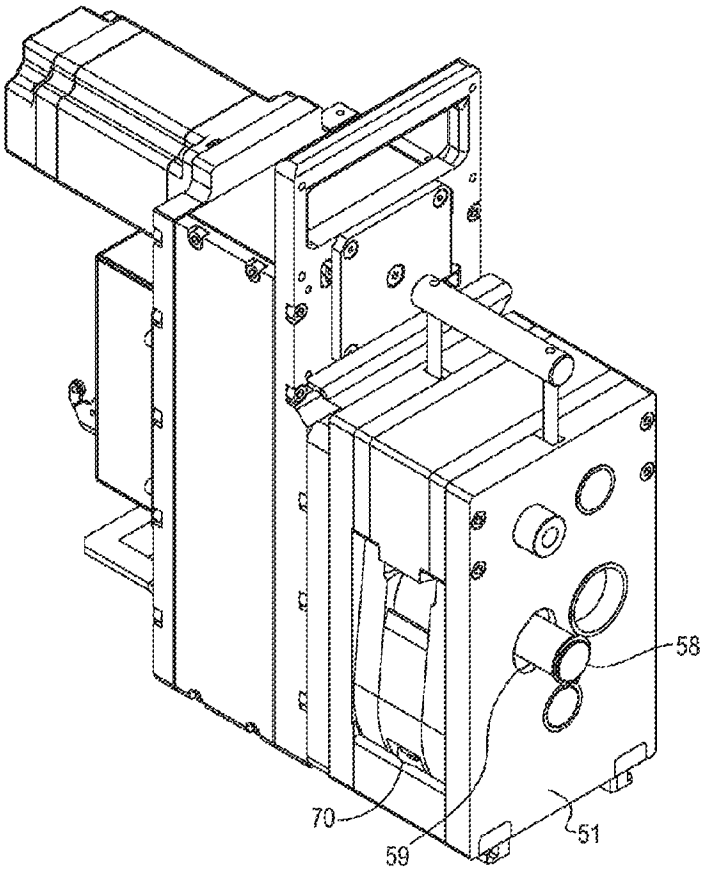
FIG. 6 is a partial perspective view of the tension assembly of FIG. 4 with the tension wheel assembly to pinch wheel link removed.
Figure 9:
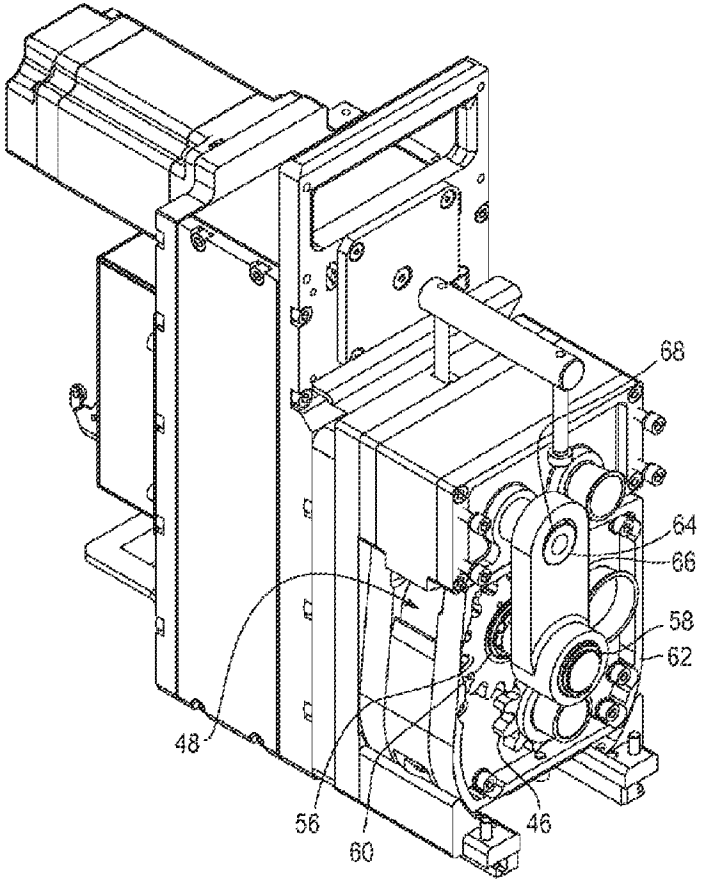
FIG. 9 is a perspective view of the of the tension assembly of FIG. 4 showing the drive wheel to tension wheel assembly link mounted to the tension wheel.
Figure 8:
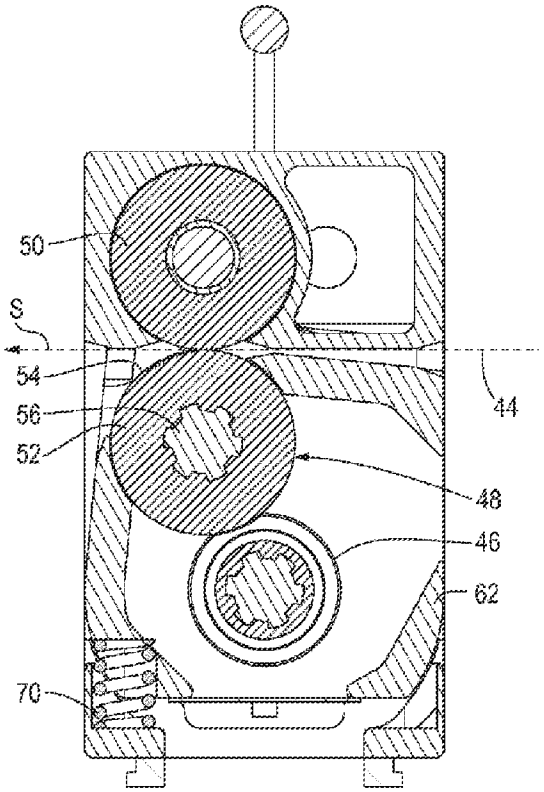
FIG. 8 is a cross-sectional view of the tension assembly of FIG. 4.

Turning to the figures, FIGS. 1-3 illustrate the strapping machine 10, which generally includes a frame 12, a feed assembly 14 (sometimes referred to as a "feed module" or a "feed head"), a tension assembly 16 (sometimes referred to as a "tension module" or a "tension head"), a strap straightener 17, a sealing assembly 18 (sometimes referred to as a "sealing module" or a "sealing head"), and a strap chute 20.

The feed assembly 14 is configured to draw strap S from a strap supply (not shown). A controller 22 controls operation of the strapping machine 10 by controlling various components (such as drives and a weld transformer) and receiving feedback from various sensors, as described below.

The controller 22 is configured to control the components of the strapping machine 10 to perform a strapping cycle (generally) including: (1) a feed cycle to convey the strap S (leading strap end first) around the load; (2) a take-up cycle to remove slack in the strap S so the strap S contacts the load; (3) a tensioning cycle to tension the strap S around the load; (4) a sealing cycle to cut the strap S from the strap supply to form a trailing strap end and to attach (in this example, to end-to-end weld) the leading and trailing strap ends of the strap S to one another at an attachment area to form a tensioned loop of strap around the load; and (5) a strap-attachment check cycle to test the strength of the strap attachment. The attachment area includes the area at which the leading and trailing strap ends of the strap meet (e.g., abut and/or overlap one another) and are attached to one another, and varies depending on the type of strapping machine and the type of strap.

More specifically, the controller 22 controls the feed assembly 14 to draw strap S from the strap supply and convey the strap S (leading strap end first) through the tension assembly 16, through the strap straightener 17, through the sealing assembly 18, into and around the strap chute 20, and back to the sealing assembly 18 in a forward direction to encircle the load (the feed cycle). The controller 22 then controls the sealing assembly 18 to grip the leading strap end of the strap S and controls the feed assembly 14 to operate in reverse to withdraw the strap S from the strap chute 20 onto the load (the take-up cycle). The controller 22 then controls the tension assembly 16 to draw tension in the strap S (the tensioning cycle) and to hold tension in the strap S at the start of the sealing cycle. With the strap S tensioned around the load, the controller 22 controls the sealing assembly 18 to cut the strap S from the strap supply to form a trailing strap end, pull the trailing strap end toward the leading strap end, and attach the leading and trailing strap ends to one another at an attachment area via an end-to-end weld to form the strap loop (the sealing cycle). The controller 22 then controls the sealing assembly 18 to pull on the (former) trailing strap end while holding the (former) leading strap end stationary to test the strength of the attachment (the strap-attachment check cycle). If the controller 22 determines that a strap-attachment condition is satisfied, the controller 22 determines that the strap attachment is satisfactory (e.g., that the strap attachment did not fail) and controls an output device to output an indication thereof. But if the controller 22 determines that the strap-attachment condition is not satisfied, the controller determines that the strap attachment is unsatisfactory (e.g., that the strap attachment failed) and controls an output device to output an indication thereof. In either case, the controller 22 then controls the sealing assembly 18 to release the strap loop.

As shown in FIG. 2, the feed assembly 14 includes a drive 24, a driven wheel 26, and a pinch wheel 28. As noted above, the controller 22 is configured to control the feed assembly 14 (and in particular the drive 24) to operate: (1) in the forward direction to draw strap S from a strap supply and feed the strap S into the tensioning head 16, the strap straightener 17, the sealing assembly 18, and the strap chute 20; and (2) in the reverse direction to pull the strap S from the strap chute 20 onto the load and consequently take up any slack in the strap S.

The feed assembly 14 is located remotely from the tension assembly 16 and the sealing assembly 18. This configuration enables the feed assembly 14 to be located outside of any enclosure 30 typically used for the tension assembly 16 and/or the sealing assembly 18 and to be located on or near the frame 12 that supports the other components of the strapping machine 10. It also enables the feed assembly 14 to be located at an elevation (e.g., near ground level) that permits ready access to the feed assembly 14 for maintenance.

As best shown in FIGS. 4-9, the tension assembly 16 is self-actuating and includes an electrical section 32 and a separate (mechanical) tension section 34. The electrical section 32 includes a drive 36 (such as an electric motor); sensors 38; and an output shaft 40 sized, shaped, positioned, and otherwise configured to operably connect to the tension section 34. The electrical section 32 and the tension section 34 are removably connectable to one another via a spring-loaded latch 42 or other suitable fastening system. This connection arrangement enables an operator to readily separate the electrical section 32 and the tension section 34 for ease of maintenance.

The tension section 34 defines a strap path (indicated generally via element number 44) through which the strap S traverses during operation of the strapping machine 10. The tension section 34 includes a drive wheel 46, a tension wheel assembly 48, and a pinch wheel 50. A cover plate 51 encloses the tension section 34. The drive wheel 46 is operably connected to the drive 36 by the motor output shaft 40. In this embodiment, the drive wheel 46 includes a drive gear and is configured to rotate clockwise to draw tension in the strap (see, e.g., FIG. 10). The tension wheel assembly 48 includes a tension wheel 52 that, in this embodiment, has a friction surface 54. The friction surface 54 can be a roughened surface, such as a diamond-patterned surface, to ensure a high friction force is created between the strap S and the tension wheel 52 during the tensioning cycle.

The tension wheel assembly 48 includes a gear 56 that mates with the drive gear 46 to transfer power from the drive 36 to the tension wheel assembly 48. The tension wheel 52 and the gear 56 are fixedly mounted to one another and to a common shaft 58. In this manner, the drive 36 transfers power to the tension wheel 52. The tension wheel 52 and the gear 56 are mounted on the shaft 58 by a one-way clutch 60 that, as described below, enables rotation of the tension wheel 52 in the tension direction (counter-clockwise) and prevents rotation of the tension wheel 52 in the opposite direction (clockwise).

The drive gear 46 and the tension wheel assembly 48 are mounted to one another by a first link 62, which can be formed as a plate or carriage as illustrated via element number 63. The first link 62 defines a first pivot arm $A_{62}$ that extends from the drive gear 46 axis though the tension wheel assembly 48 axis.

The pinch wheel 50 is mounted to a shaft 64 and is disposed opposite the drive gear 46 for contact with the tension wheel 52. During the tensioning cycle, strap S is captured between the tension wheel 52 and the pinch wheel 50, and the pinch wheel 50 provides a surface against which the strap S is engaged to tension the strap S.

The tension wheel assembly shaft 58 and the pinch wheel shaft 64 are mounted to one another by a second link 66. The second link 66 has a slotted opening 68 in which it receives the pinch wheel shaft 64. This enables the tension wheel 52 to move into and out of contact with the pinch wheel 50. The second link 66 defines a second pivot arm $A_{66}$ that is at an angle α, referred to as the "energizing angle," to the first pivot arm $A_{62}$.

Figure 11:
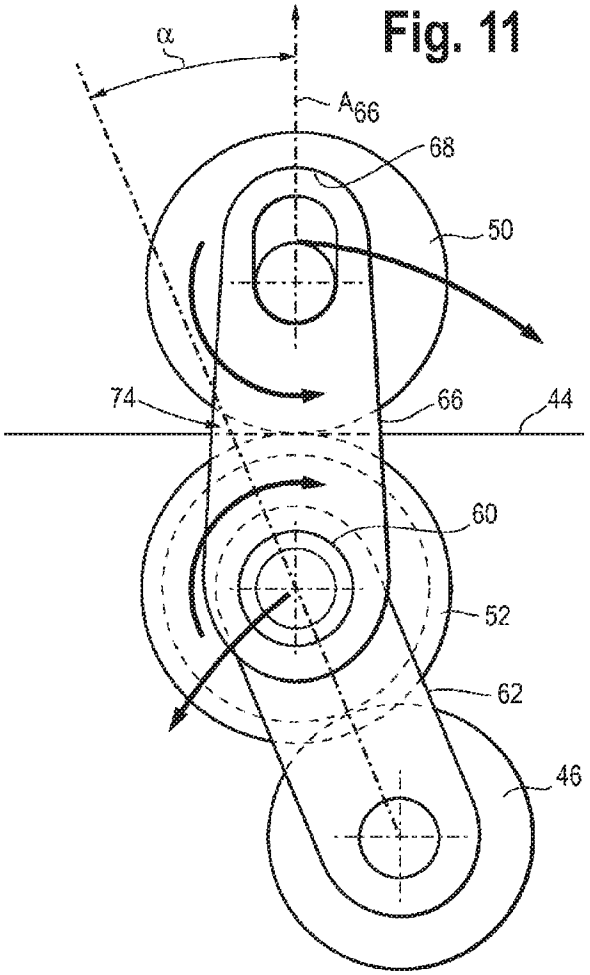
FIG. 11 is a schematic illustration of the tension assembly of FIG. 4 showing how the tension assembly opens to enable the strap to feed therethrough.
Figure 10:
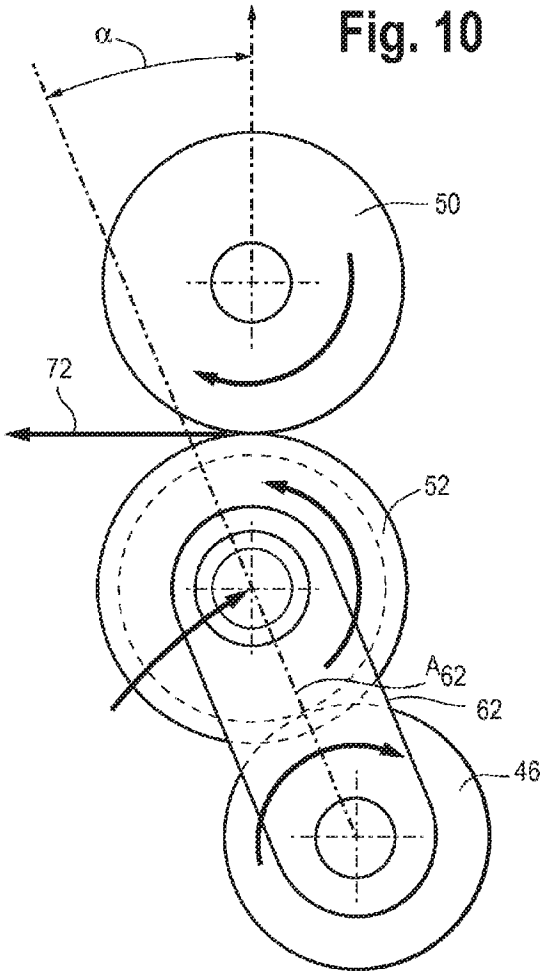
FIG. 10 is a schematic illustration of the tension assembly of FIG. 4 during the tensioning cycle.

Both the drive wheel 46 (gear) and the pinch wheel 50 are fixed transverse to their respective axes of rotation, but the tension wheel assembly 48 (the shaft 58) floats in the transverse direction. In this manner, as illustrated in FIGS. 10 and 11, the energizing angle α varies depending on the "float" of the tension wheel assembly 48. A spring 70 biases the tension wheel 52 into contact with the pinch wheel 50.

When operating in the tensioning cycle, as seen in FIG. 10, the controller 22 actuates the drive 36. This rotates the drive gear 46, which in turn is meshed with the tension wheel assembly gear 56. As illustrated in. FIG. 10, the drive 36 and the drive gear 46 thus rotate clockwise, which causes the tension wheel 52 to rotate counter-clockwise. With the strap S positioned between the tension wheel 52 and the pinch wheel 50, the strap S is drawn to the left, in tension, as illustrated by the arrow 72.

With the tension wheel 52 capturing the strap S (between the tension wheel 52 and pinch wheel 50), the tension wheel 52 rotates counter-clockwise, but the first link 62 (i.e., the tension wheel assembly to drive wheel link) will tend to pivot clockwise, and thus the tension wheel 52 will attempt to creep up on the pinch wheel 50. This is due to the floating mount of the tension wheel assembly 48, the pivoting mount of the first link 62, and the slotted opening in the second link 66 (i.e., the tension wheel assembly to pinch wheel link). As the first link 62 pivots clockwise, the energizing angle α decreases, which increases the normal force of (and the pressure exerted by) the tension wheel 52 on the pinch wheel 50, thus increasing the grip on the captured strap S.

As shown in FIG. 11, when operating in the feed direction, as the drive 36 and the drive gear 46 rotate counter-clockwise, the one-way clutch 60 mounting the tension wheel assembly 48 to the shaft 58 prevents rotation of the tension wheel 52. The force the drive gear 46 exerts acts to pivot the second link 66 counter-clockwise, overcoming the force of the spring 70 that biases the tension wheel 52 into contact with the pinch wheel 50. Because of the slot 68 in the tension wheel assembly to pinch wheel link (the second link 66), the tension wheel 52 moves or pivots out of contact with pinch wheel 50 and opens a gap or space (indicated generally at 74) for the strap S to move freely in the forward direction in the feed cycle between the pinch wheel 50 and the tension wheel 52. A proximity sensor 71 located in the tension assembly 16 (FIG. 12) is configured to sense when the tension wheel 52 (as mounted to the first link 62) is pivoted away from the pinch wheel 50 and communicates this information to the controller 22, which in response controls the drive 36 to stop driving the drive gear 46. The link 62 and the tension wheel 52 are maintained in position during the feed cycle.

Figure 12:
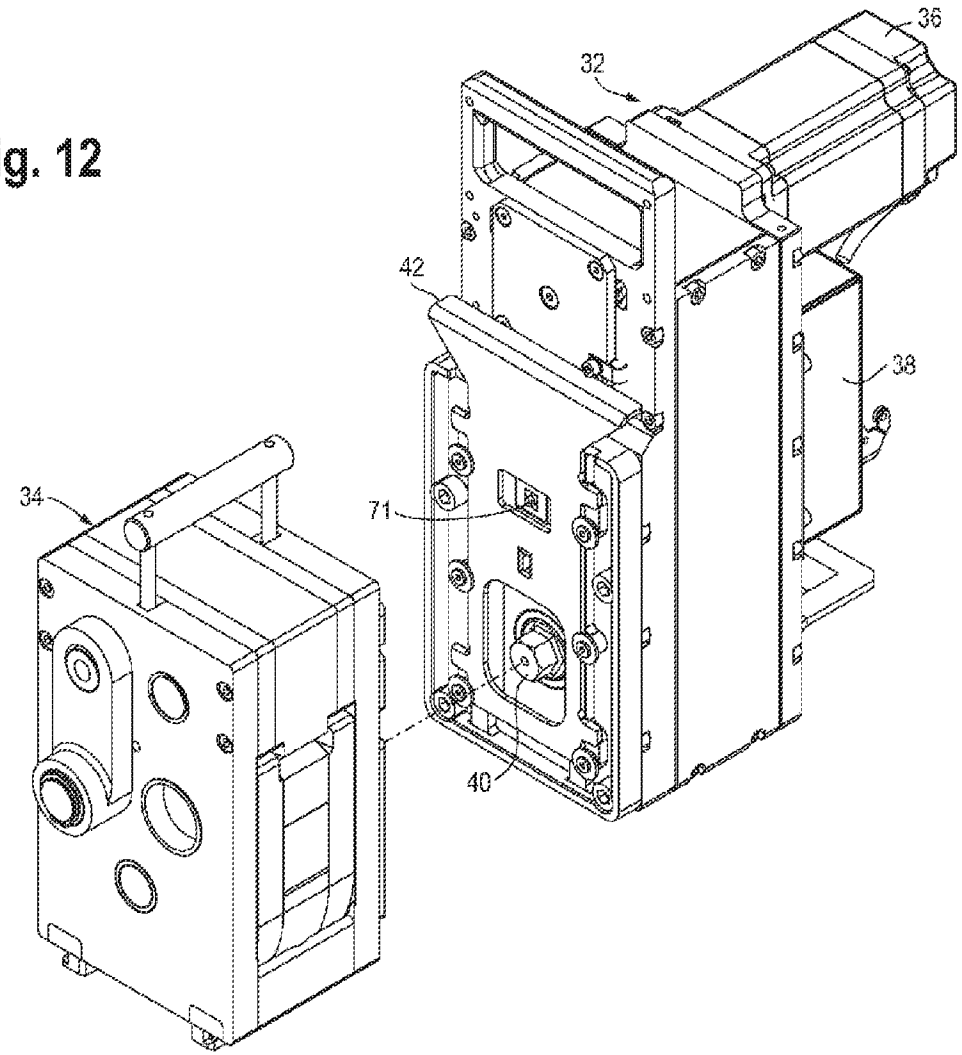
FIG. 12 is a perspective view of the tension assembly of FIG. 4 with the electrical section separated from the tension section.
Figure 12A:
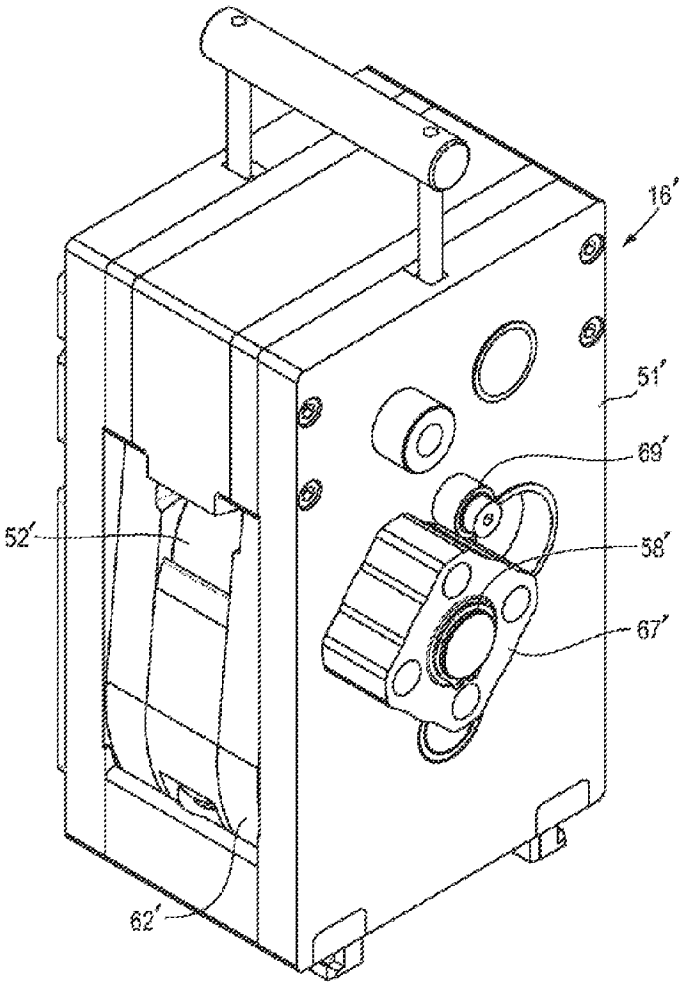
FIG. 12A is a perspective view of another embodiment of the tension assembly.
Figure 13:
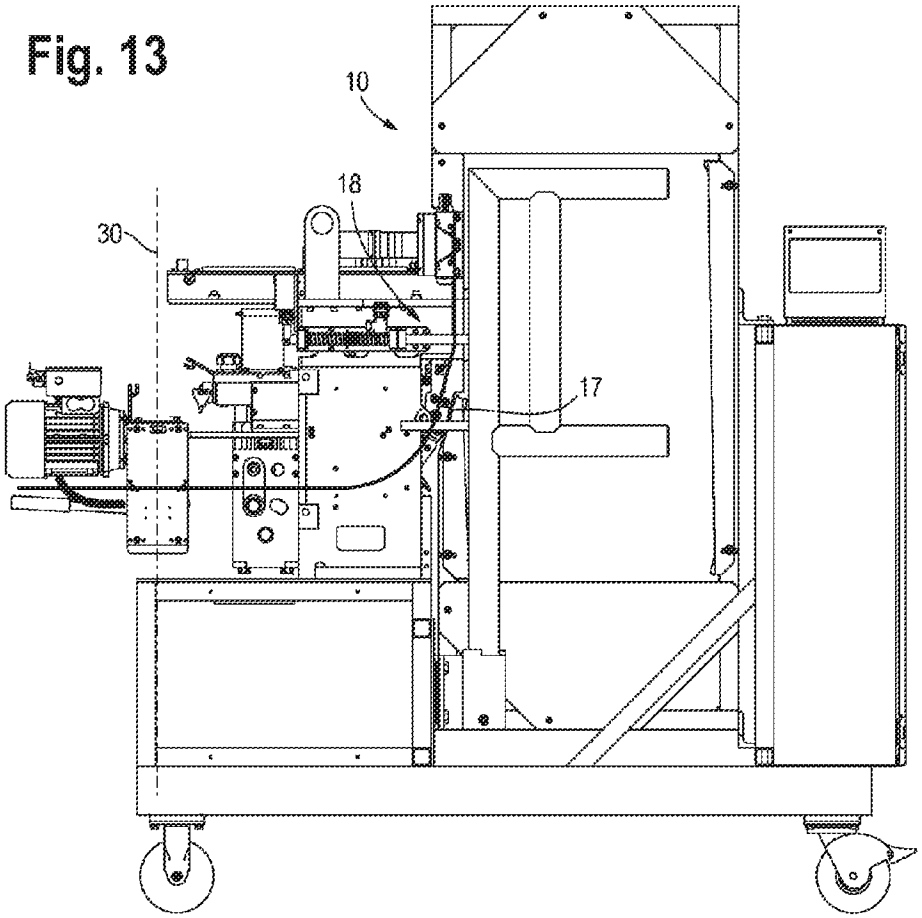
FIG. 13 is a front view of the strapping machine of FIG. 1.
Figure 14:
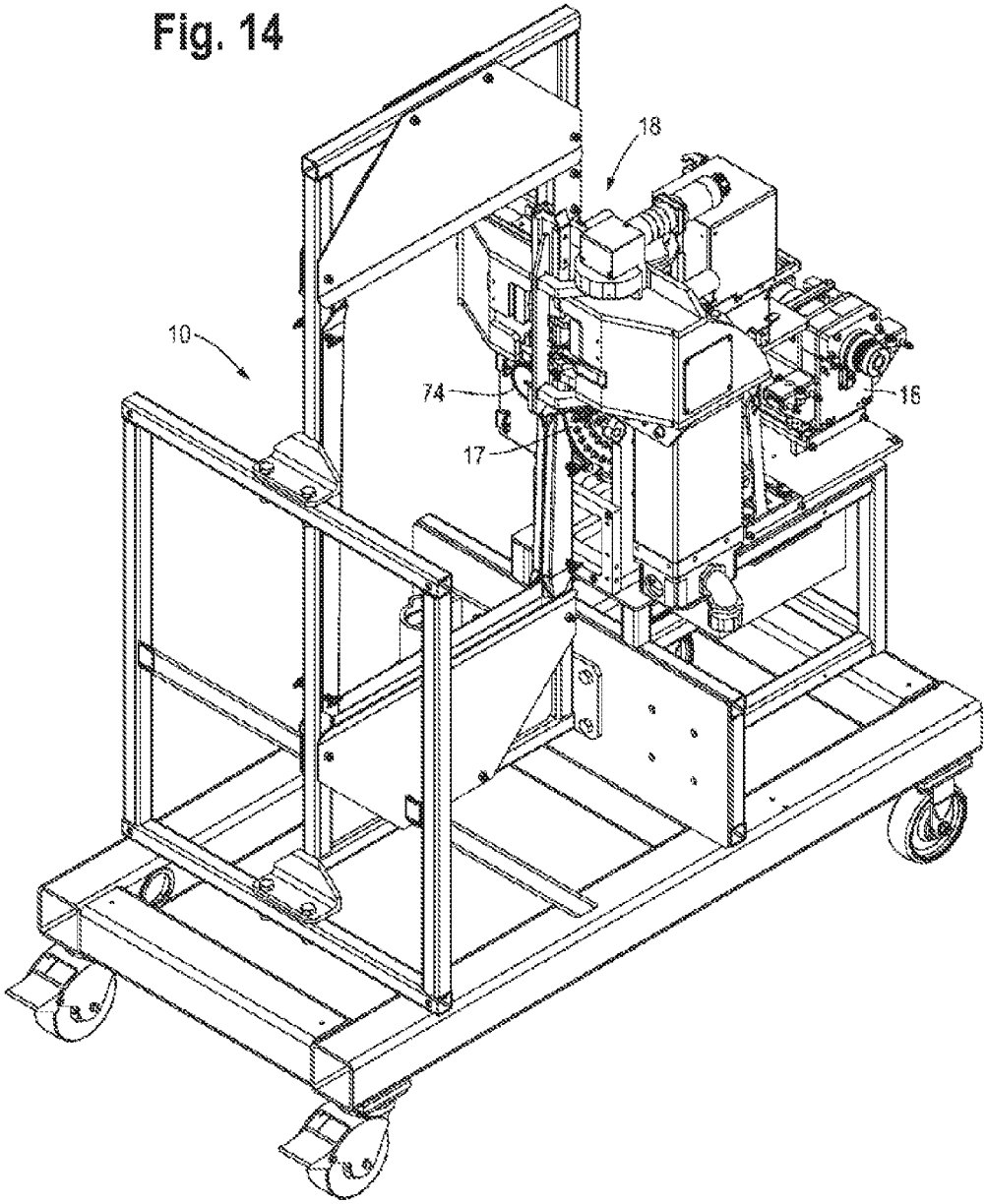
FIG. 14 is a perspective view of the strapping machine of FIG. 1.
Figure 16:
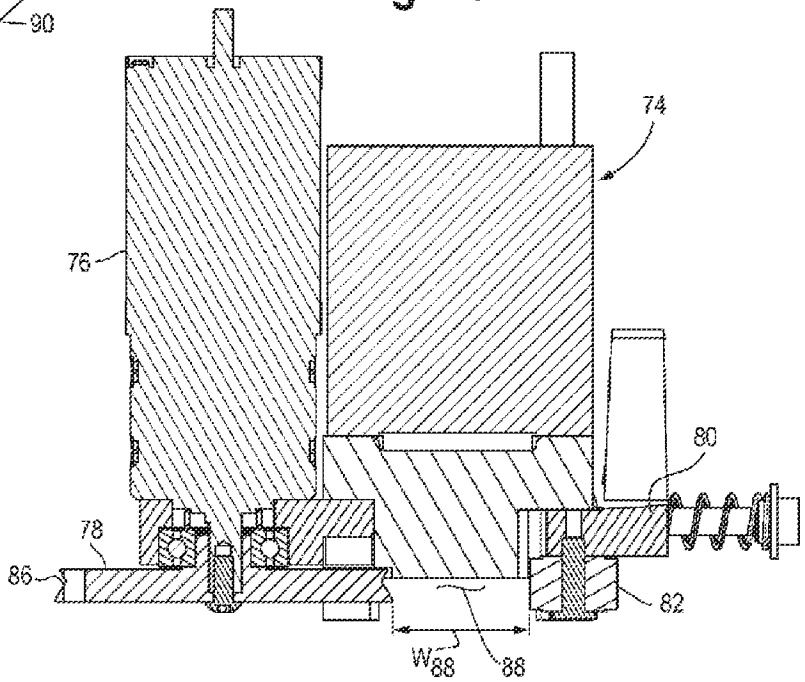
FIG. 16 is a partial cross-sectional view of the feed limit assembly of FIG. 15.
Figure 15:
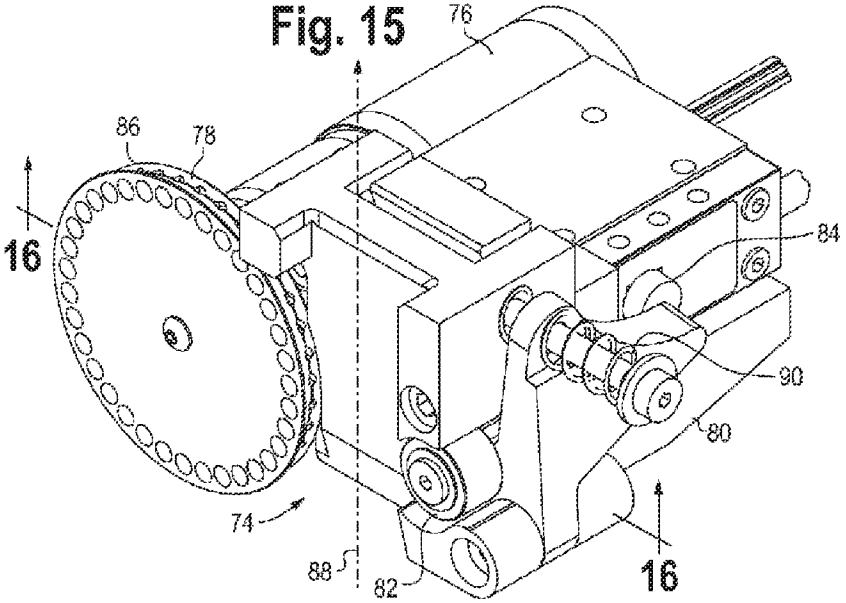
FIG. 15 is a perspective view of the feed limit assembly of the strapping machine of FIG. 1.
Figure 17:
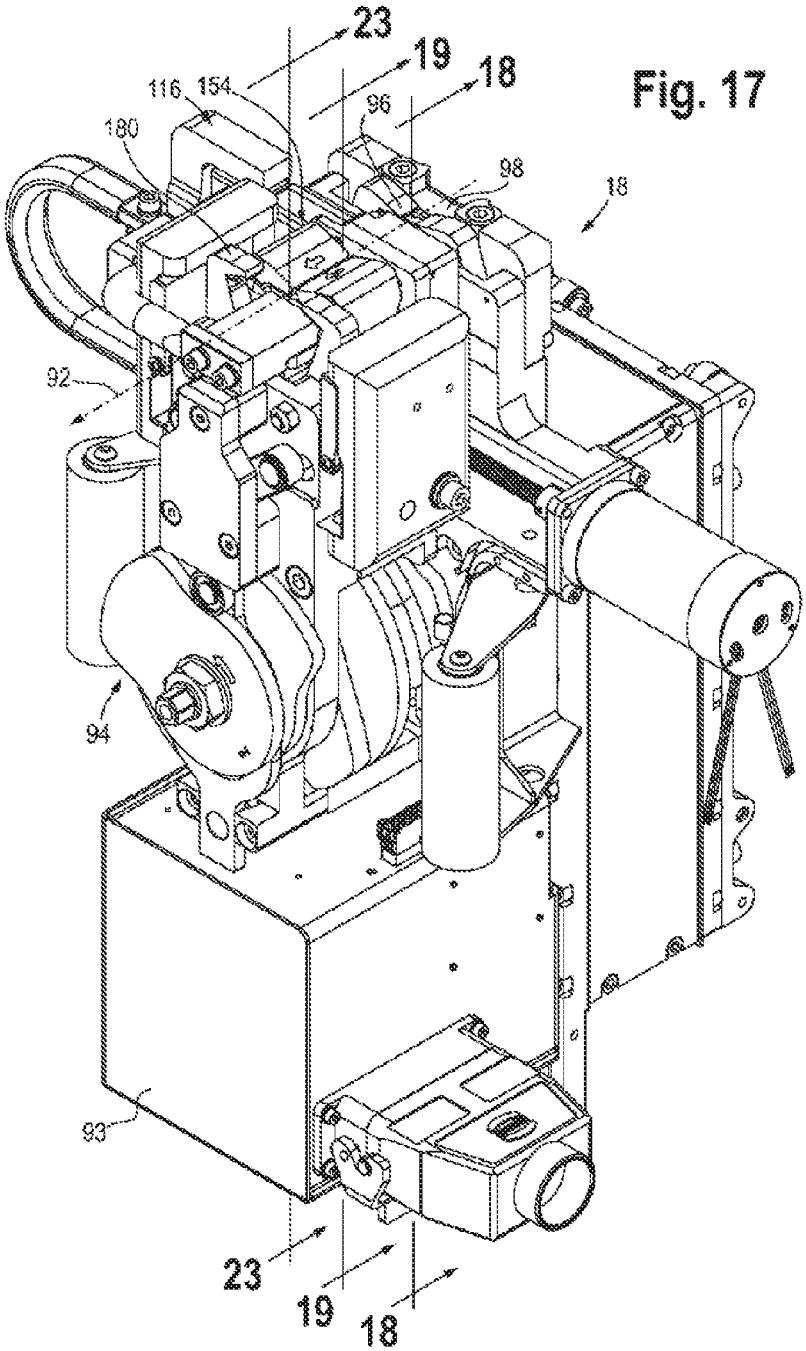
FIG. 17 is a perspective view of the sealing assembly of the strapping machine of FIG. 1.

FIG. 12A illustrates an alternate embodiment of the tension assembly 16'. In this embodiment, the internal and drive elements of the tension assembly 16' are the same as those of the embodiment of the tension assembly 16 illustrated in FIGS. 6-12. But rather than a linkage 66, the tension assembly 16' includes a cam 67' mounted to the shaft 58' and a cam follower 69' mounted to the cover plate 51' to facilitate pivoting of the tension wheel 52' and the first linkage 62'.

Referring to FIGS. 2 and 35-38, the strap straightener 17 is positioned between the tension assembly 16 and the sealing assembly 18. The strap straightener 17 is configured to straighten the strap S to counteract any end-to-end curl that may be induced in the strap S as a result of, for example, the tensioning cycle. As shown in FIG. 2, the path between the tension assembly 16 and the sealing assembly 18 is curved such that the strap S is reoriented from a horizontal path from the feed assembly 14 to a vertical path at the sealing assembly 18 and the strap chute 20. As a result, during the tensioning cycle, an end-to-end curl is induced in the strap due to the curved path and the tension drawn on the strap S. This end-to-end curl can result in misfed strap and strap jams.

The strap straightener 17 is provided to counteract the end-to-end curl by bending the strap S in a direction opposite of the induced end-to-end curl. The strap straightener 17 includes a body 194, an inlet guide element 196, an outlet guide element 198, and a movable straightening element 200. In this embodiment, the inlet guide element 196 includes a pair of spaced-apart rollers **202*a* and 202*b* each having a separate roller axis $A_{202}$, and the outlet guide element 198 includes a pair of spaced-apart rollers 204*a* and 204*b* each having a separate roller axis $A_{204}$. The rollers 202*a* and 202*b* of the inlet guide element 196 are spaced a fixed distance from one another and are fixed relative to the body 194. The rollers 204*a* and 204*b* of the outlet guide element 198 are spaced a fixed distance from one another and are fixed relative to the body 194**. The roller axes $A_{202}$ and $A_{204}$ are fixed such that a plane $P_{202}$ and $P_{204}$ through each pair of axes $A_{202}$ and $A_{204}$ is fixed, and the planes $P_{202}$ and $P_{204}$ are fixed relative to one another.

The movable straightening element 200 also includes a pair of rollers **206*a* and 206*b* each having a roller axis $A_{206}$. The rollers 206*a* and 206*b* are mounted to a carriage 208 that is movable relative to the inlet guide element 196 and the outlet guide element 198. In this embodiment, the carriage 208 is pivotable relative to the inlet guide element 196 and the outlet guide element 198, as indicated by the double headed arrow 210. In this manner, a plane $P_{206}$ through the pair of axes $A_{206}$ of the movable element rollers 206*a* and 206*b*** is movable relative to the fixed element roller planes $P_{202}$ and $P_{204}$.

To enable the carriage 208 to pivot, the carriage 208 includes a stub shaft 212 extending therefrom. A pivot link 214 is mounted to the stub shaft 212 such that pivoting the pivot link 214 pivots the carriage 208 and thus the movable straightening element 200. In this embodiment, the pivot link 214 includes teeth 216 that can be meshed with a drive gear 218. The drive gear 218 can be driven by a drive or manually driven to move the pivot link 214. A fastener 220, such as the illustrated shoulder bolt, secures the movable element 200 in a desired position.

As illustrated in FIGS. 13-16, a feed limit assembly 74 is located in the strap path at about the end of the strap chute 20 to receive the leading strap end of the strap S as the leading strap end is conveyed into the sealing assembly 18 after traversing the strap chute 20. The feed limit assembly 74 can be positioned adjacent to the strap straightener 17. The feed limit assembly 74 includes a drive 76, a drive wheel 78, a biased carriage 80 and roller 82, and a sensor 84. In this embodiment, the drive wheel 78 has a notched or V-shaped edge or groove 86, and the roller 82 is positioned opposite the groove 86. The V-shaped groove 86 and the roller 82 define a strap path 88. The roller 82 is mounted to the biased carriage 80, which biases the roller 82 toward the wheel 78 via a spring 90. The strap path 88 has a predetermined width $W_{88}$ that, when the carriage 80 (and the roller 82) are in a home position, is slightly less than a width of the strap S. Alternatively, although not shown, the feed limit assembly can include a drive wheel with a one-way clutch bearing instead of a drive.

In this embodiment, the sensor 84 is positioned adjacent to the carriage 80 so that the carriage 80 pivots into and out of contact (electro, electro-mechanical, and/or mechanical contact) with the sensor 84. As the strap S passes into the strap path 88, the strap S rides in the groove 86 and contacts the roller 82, which in turn pivots the carriage 80 away from the sensor 84. In one embodiment, the sensor 84 is a proximity sensor.

As shown in FIGS. 35-38, a strap return sensor 84' can be positioned on the body 194 of the strap straightener 17. In this configuration, as the strap S returns toward the sealing assembly 18, the strap S contacts a limit flag 222, which is operably mounted to a sensor contact 224 that moves into contact with the sensor 84'. A spring 226 biases the limit flag 222 into the strap path. This configuration of the strap sensor 84' and its components can be used in place of the pivoting carriage 80 of the embodiment of FIGS. 15-16.

The feed limit assembly 74 provides various functions. First, upon sensing that the strap S has entered the strap path 88, the sensor 84 provides a signal to the controller 22 and/or the feed assembly 14 to indicate that the leading strap end of the strap S is returning to the sealing assembly 18. Second, the feed limit assembly drive 76 and the wheel 78 provide sufficient motive force on the strap S to ensure the leading strap end of the strap S is urged into the sealing assembly 18 and is properly positioned for operation of the sealing assembly 18.

FIGS. 17-34 illustrate the sealing assembly 18. The sealing assembly 18 functions, in an overall sealing cycle, to receive the strap S as it passes through the sealing assembly 18 and into the strap chute 20, receive the leading strap end that returns from the strap chute 20, grip the leading strap end, cut the strap S from the strap supply to form a trailing strap end, and attach the leading and trailing strap ends to one another via an end-to-end weld. The sealing assembly 18 automatically carries out the end-to-end weld while holding the strap S in tension around the load. To form the end-to-end weld, the sealing assembly 18 is configured to move the trailing strap end toward the leading strap end, as described below.

The sealing assembly 18 defines a strap path 92 therethrough. Several assemblies are aligned along the strap path 92. A cam 94 is located within the sealing assembly 18 and is driven by a cam drive 93. The cam 94 includes several lobes that cooperate with corresponding cam followers within the sealing assembly 18 to move the assemblies during the strapping cycle, as will be described below. Put differently, the cam 94 is operatively connected (via the cam followers) with the assemblies to move them during the strapping cycle.

Figure 18:
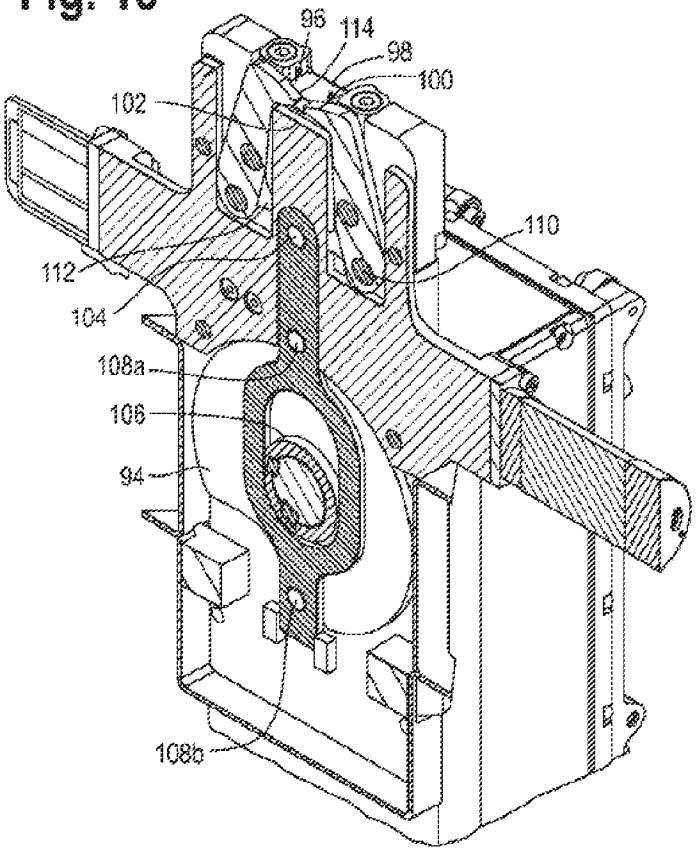
FIG. 18 is a partial cross-sectional view of the sealing assembly of FIG. 17 showing the end grip.

Referring to FIG. 18, a leading strap end grip 96 is at the inlet 98 of the sealing assembly 18. The leading strap end grip 96 includes a pair of leading strap end grip jaws 100 that define an upper guide of the strap path 92. The leading strap end grip jaws 100 are movable between an open position in which the leading strap end grip jaws 100 can receive the strap S and a closed position in which the leading strap end grip jaws 100 contact and clamp the leading strap end of the strap S against a leading strap end grip clamp anvil 102. The leading strap end grip clamp anvil 102 is formed as part of an anvil link 104 that moves with the leading strap end grip jaws 100 between the open and closed positions.

A dual-acting cam 106 having a pair of cam followers 108*a* and 108*b* is configured to move the leading strap end grip jaws 100 and the leading strap end grip clamp anvil 102 (and the anvil link 104) between the open and closed positions. A first cam follower 108*a* on the anvil link 104 is configured to move the leading strap end grip clamp anvil 102 and the leading strap end grip jaws 100 into the closed position, and a second cam follower 108*b* on an opposite side of the anvil link 104 is configured to move the leading strap end grip clamp anvil 102 and the leading strap end grip jaws 100 into the open position.

The leading strap end grip jaws 100 are pivotable about a pivot joint 110, such as the illustrated pivot pin. Link arms 112 extend from the anvil link 104 to the leading strap end grip jaws 100 to pivot the leading strap end grip jaws 100. As the anvil link 104 moves upwardly (following the cam follower 108*a*) to move the leading strap end grip clamp anvil 102 toward the strap path 92, the link arms 112 pivot the base of the leading strap end grip jaws 100 outwardly, which in turn pivots a gripping portion 114 of the leading strap end grip jaws 100 inwardly onto the strap S. Conversely, as the cam 94 continues to rotate and the opposing cam follower 108*b* contacts the anvil link 104, it moves the anvil link 104 (and thus the leading strap end grip clamp anvil 102) downwardly and pivots the leading strap end grip jaws 100 to open the leading strap end grip 96.

Figure 19B:
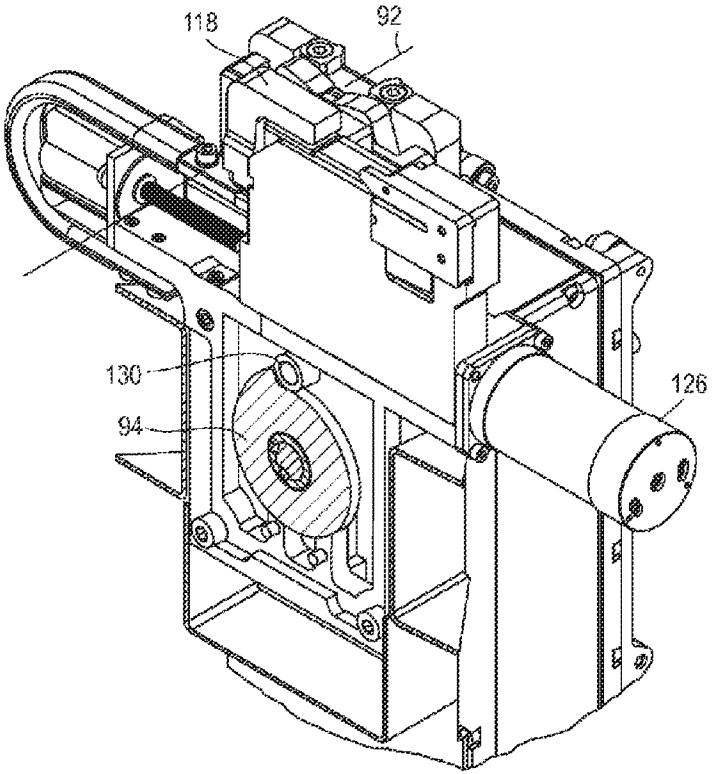
FIGS. 19*a* and 19*b* are partial sectional views of the sealing assembly of FIG. 17 showing the grip clamp/cutter shuttle.
Figure 19A:
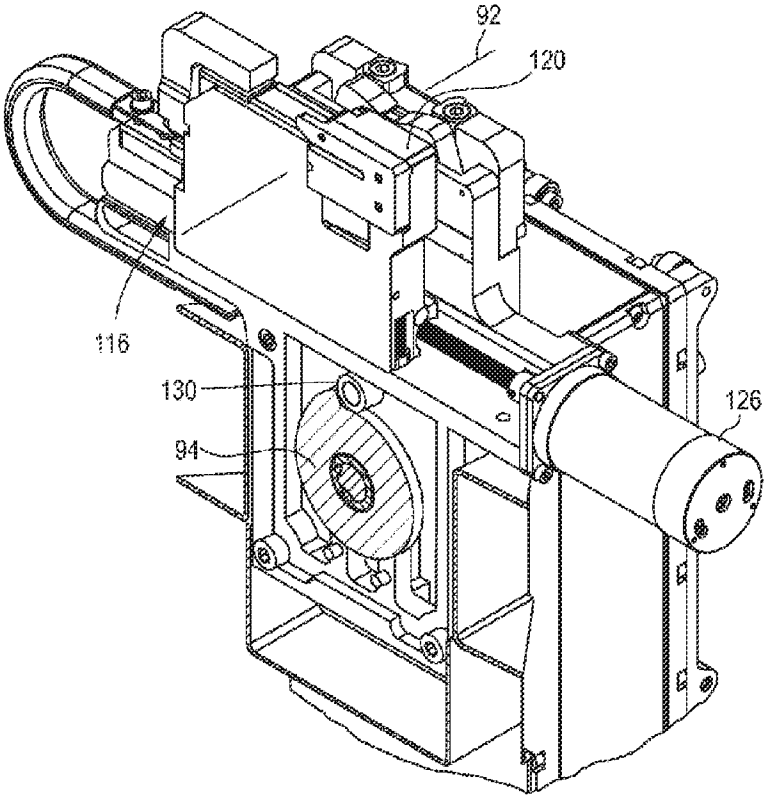
Figure 20B:
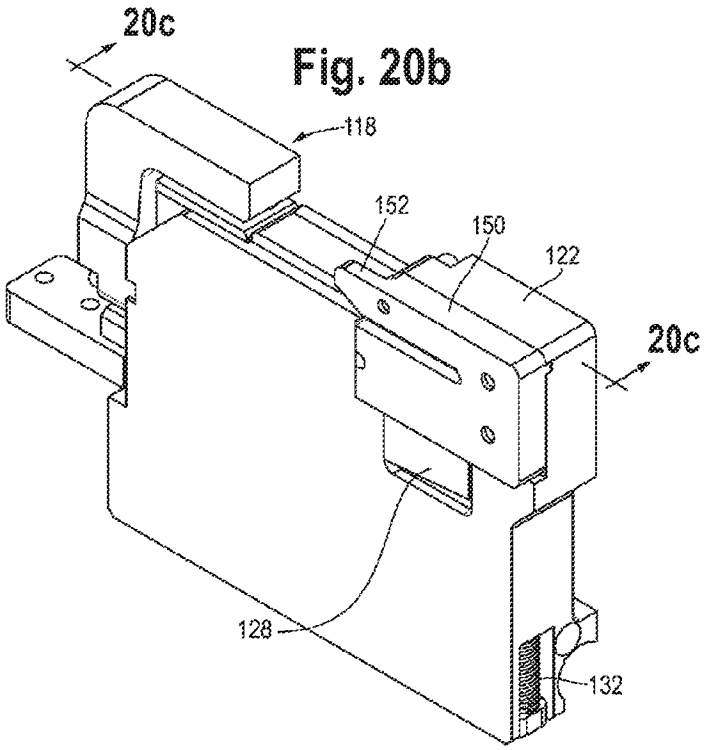
FIGS. 20*a*, 20*b*, 20*c*, 20*d*, and 20*e* are various views of the grip clamp/cutter shuttle of the sealing assembly of FIG. 17.
Figure 20A:
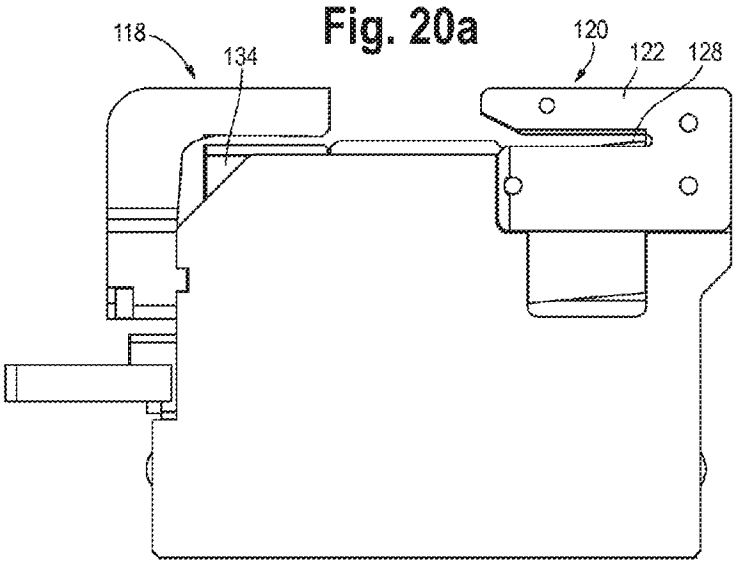
Figure 20C:
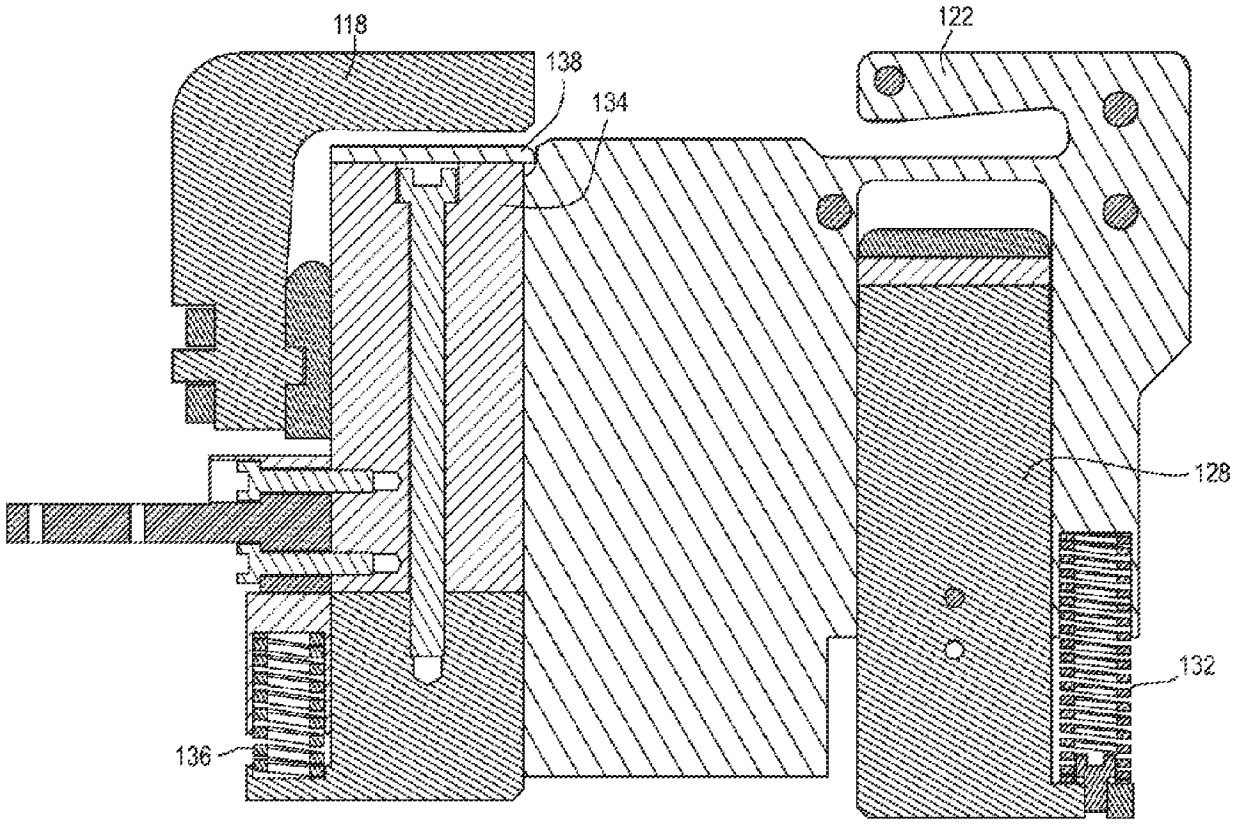
Figure 20E:
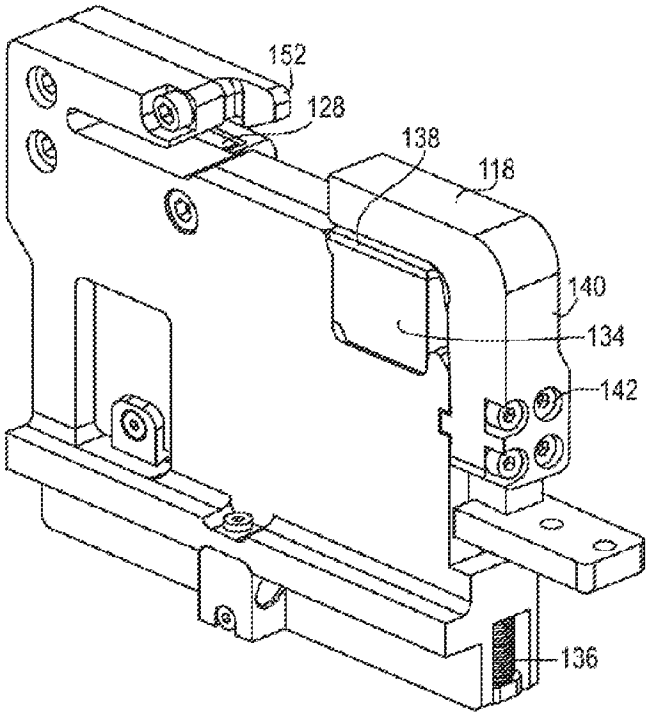
Figure 20D:
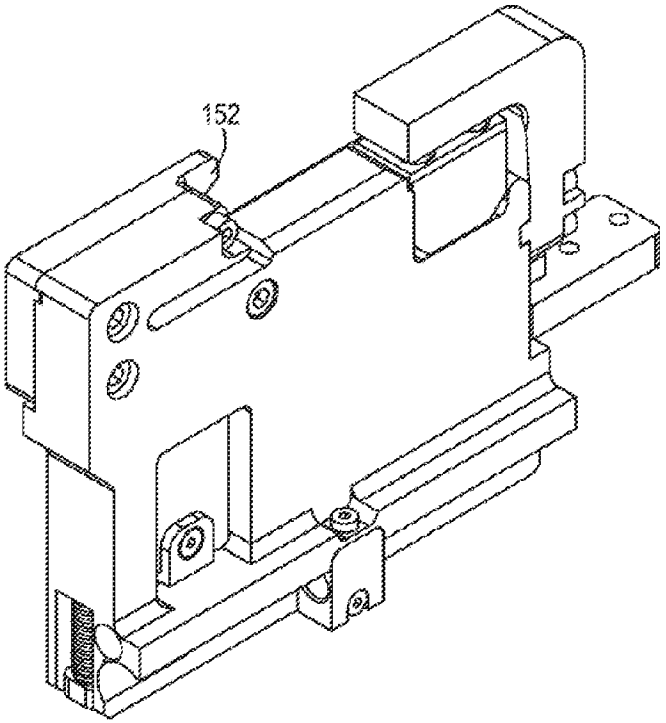
Figure 21:
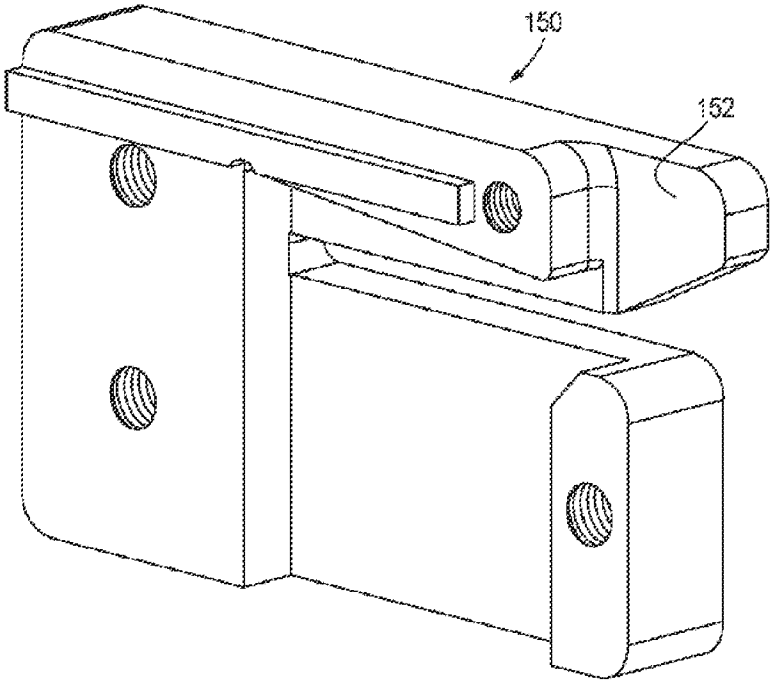
FIG. 21 is a perspective view of the stationary portion of the cutter anvil of the sealing assembly of FIG. 17.
Figure 22B:
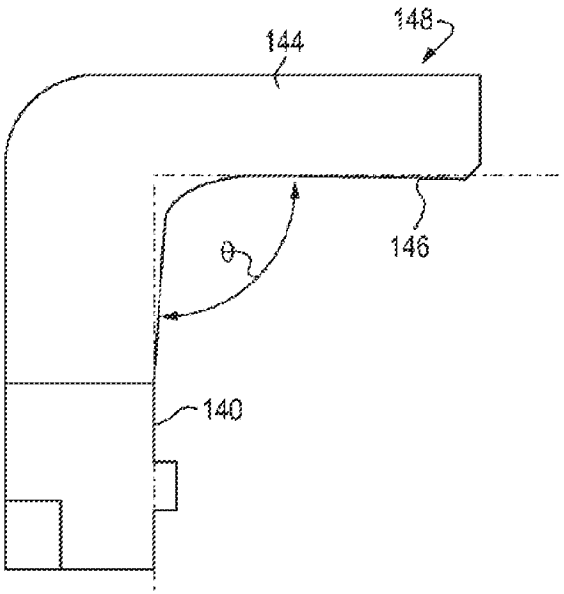
FIGS. 22*a* and 22*b* are perspective and side views of the grip clamp of the sealing assembly of FIG. 17.
Figure 22A:
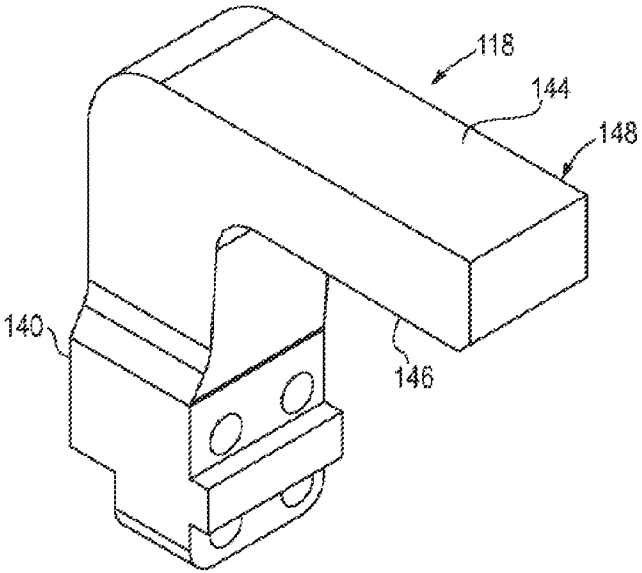

A grip clamp/cutter shuttle 116 that includes a leading strap end grip clamp 118 and a cutter 120 is adjacent to the leading strap end grip 96. FIGS. 19-20 generally illustrate the shuttle 116, FIG. 21 illustrates a cutter anvil 122, and FIGS. 22*a* and 22*b* illustrate the leading strap end grip clamp 118. The shuttle 116 is movable transverse to the strap path 92 to: (1) move the cutter 120 into the strap path 92 to cut the strap S from the supply to form the trailing strap end; and (2) move the leading strap end grip clamp 118 into place during the strap-attachment cycle. The shuttle 116 has three transverse positions relative to the strap path 92: (1) the cutting position (FIG. 19*a*); (2) the strap-attaching position (FIG. 19*b*); and (3) a home or intermediate position (not shown) between the cutting and strap-attaching positions. The shuttle 116 includes a drive 126, such as the illustrated linear actuator (or any other suitable actuator), to carry out the transverse movement under control of the controller 22. The drive 126 is in addition to the cam drive 93.

The cutter 120 includes the stationary cutter anvil 122 and a cutter 128 that is movable between a home position and a cutting position. Movement of the cutter 128 upward toward the cutter anvil 122 from the home position to the cutting position causes the cutter 128 to cut the strap S from the strap supply to form the trailing strap end. A cam follower 130 cooperating with the rotating cam 94 is configured to move the cutter 128 toward the strap path 92. Springs 132 (FIG. 20*c*) or any other suitable biasing element(s) bias the cutter 128 to the home position.

The leading strap end grip clamp 118 is fixedly mounted to the shuttle 116, and a leading strap end grip clamp anvil 134 is movable relative to the leading strap end grip clamp 118 from a retracted position to a clamping position toward the leading strap end grip clamp 118 to capture the leading strap end of the strap S between the leading strap end grip clamp 118 and the leading strap end grip clamp anvil 134 during the strap-attachment cycle. The leading strap end grip clamp anvil 134 is mounted within the shuttle 116 and biased to the retracted position by a spring 136. The leading strap end grip clamp anvil 134 includes a conductor surface or electrode 138 thereon to conduct current during the strap-attachment cycle.

The leading strap end grip clamp 118 (FIGS. 22*a* and 22*b*) includes a base portion 140 mounted to the shuttle 116 by fasteners 142 (FIGS. 20*d* and 20*e*) and a cantilevered clamp portion 144 that extends over the strap path 92. The leading strap end grip clamp 118 is configured to secure the leading strap end against the leading strap end grip clamp anvil 134 during the strap-attachment cycle. As best shown in FIG. 22*b*, the leading strap end grip clamp 118 includes a contact surface 146 that, when in a relaxed state, is slightly angled (as indicted at θ, which is less than 90 degrees) toward the leading strap end grip clamp anvil 134. A significant force must be exerted on the leading strap end grip clamp 118 during the strap-attachment cycle to ensure maximum contact between the leading strap end and the electrode 138. It is therefore desirable to position as much surface area of the leading strap end grip clamp 118 as practical on the leading strap end. Given that such parts (and in particular cantilevered parts) will flex with increasing pressure applied to the cantilevered end 146, the cantilevered end 146 is slightly angled at its free end 148 toward the electrode 138 (and the leading strap end grip clamp anvil 134). This ensures that the leading strap end grip clamp 118 remains flat when in contact with the strap S as the cantilevered end 148 flexes.

An end stop 150 is formed as part of the shuttle 116. The end stop 150 moves transversely with the shuttle 116 and includes a stop surface 152 that the leading strap end of the strap S contacts as it returns to the sealing assembly 18 after traversing through the strap chute 20.

Figure 23:
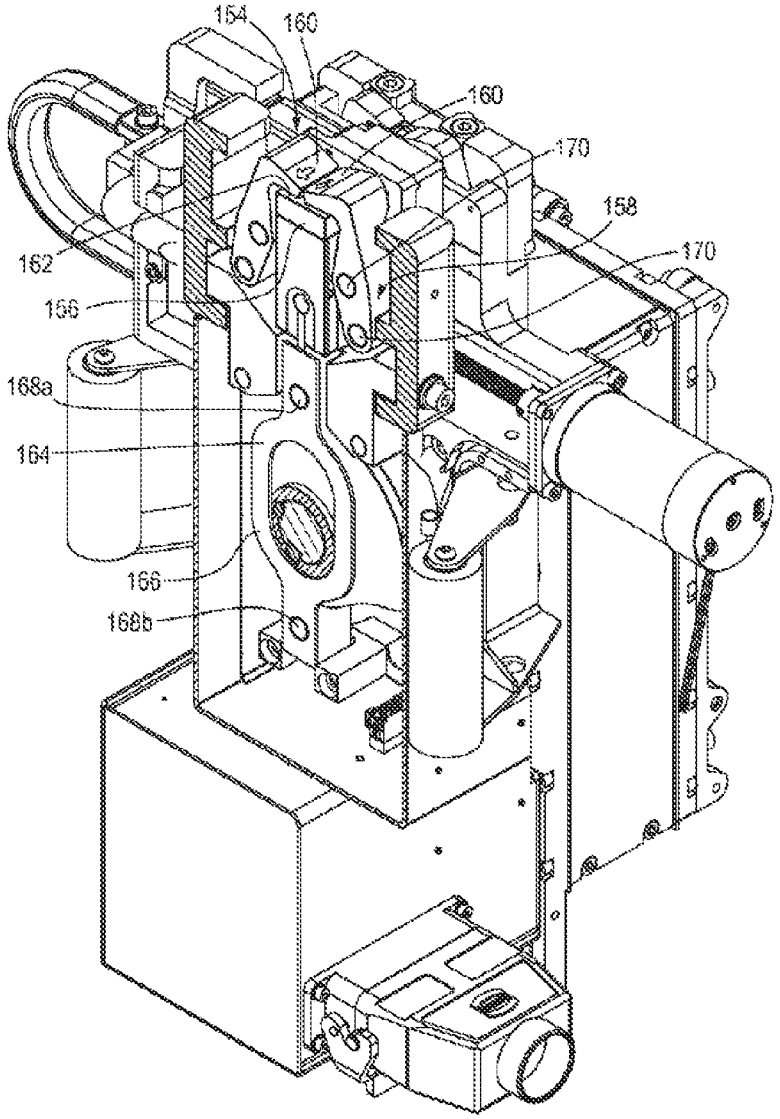
FIG. 23 is a cross-sectional view of the sealing assembly of FIG. 17 showing the trailing strap end grip and the trailing strap end grip carriage.

As shown in FIG. 23, a trailing strap end grip 154 is adjacent to the stop surface 152. The trailing strap end grip 154 is configured: (1) to secure the trailing strap end of the strap S (i.e., the strap end cut from the strap supply); and (2) during the strap-attachment cycle, move the trailing strap end toward the leading strap end and provide a conductor surface or electrode 156 for carrying out the end-to-end weld. A trailing strap end grip carriage 158 carries the trailing strap end grip 154. The trailing strap end grip 154 includes a pair of trailing strap end grip jaws 160 that also define an upper guide of the strap path 92. The trailing strap end grip jaws 160 are movable between an open position in which strap S can move through the sealing assembly 18 and a closed position in which the trailing strap end grip jaws 160 contact and clamp the strap S against an trailing strap end grip clamp anvil 162. The trailing strap end grip jaws 160 can be provided with teeth 161 to secure the trailing strap end against the trailing strap end grip clamp anvil 162. The trailing strap end grip clamp anvil 162 is formed as part of the carriage 158 and includes the electrode 156 against which the trailing strap end is secured for conduct of current during the strap-attachment cycle. The trailing strap end grip 154 includes an anvil link 164 that moves with the trailing strap end grip jaws 160 between the open and closed positions.

The trailing strap end grip carriage 158, which includes the trailing strap end grip jaws 160 and the trailing strap end grip clamp anvil 162 (and the anvil link 164), is movable between the open and closed positions by a dual-acting cam 166 having a pair of cam followers 168*a* and 168*b*. A first cam follower 168*a* on the anvil link 164 is configured to move the trailing strap end grip clamp anvil 162 and trailing strap end grip jaws 160 into the closed position and a second cam follower 168*b* on an opposite side of the anvil link 164 is configured to move the trailing strap end grip clamp anvil 162 and trailing strap end grip jaws 160 into the open position.

The trailing strap end grip jaws 160 are pivotable about a pivot joint, such as the illustrated pivot pin 170. Link arms 172 extend from the anvil link 164 to the trailing strap end grip jaws 160 to pivot the trailing strap end grip jaws 160. As the anvil link 164 moves upwardly (following the cam follower 168*a*) to move the trailing strap end grip clamp anvil 162 toward the strap path 92, the link arms 172 pivot the base of the trailing strap end grip jaws 160 outwardly, which in turn pivots the upper portion of the trailing strap end grip jaws 160 inwardly to secure the trailing strap end against the trailing strap end grip clamp anvil 162. Conversely, as the cam 166 continues to rotate and the opposing cam follower 168*b* contacts the anvil link 164, it moves the anvil link 164 (and thus the trailing strap end grip clamp anvil 162) downwardly and moves the link arms 172 to open the trailing strap end grip jaws 160.

Figure 24:
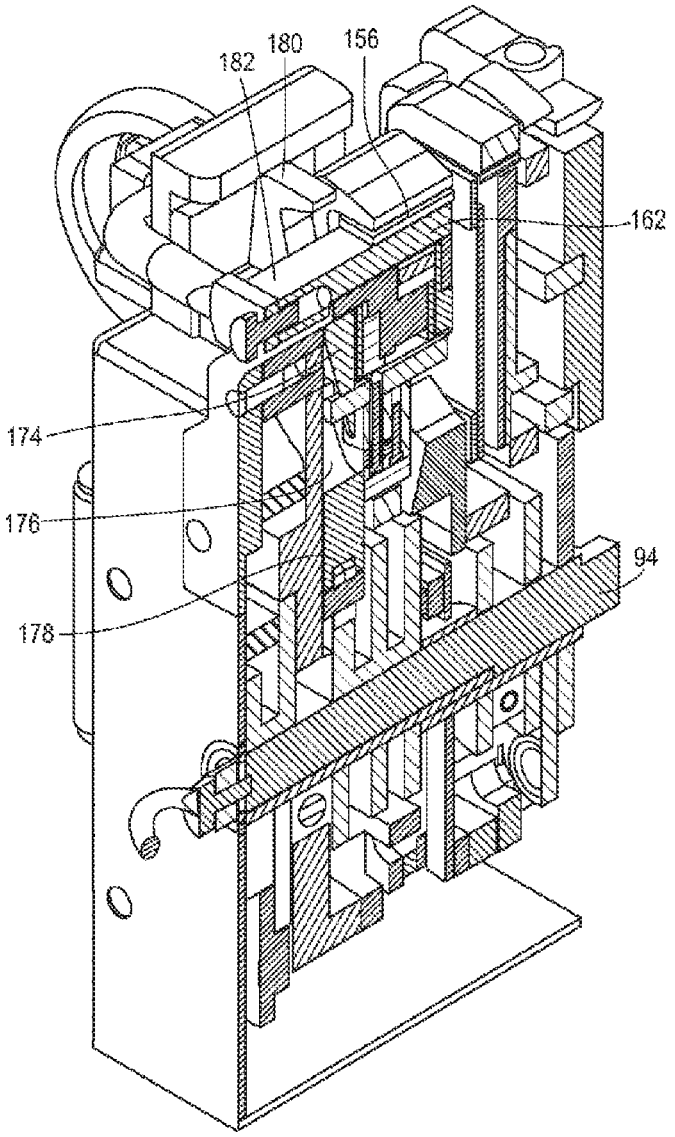
FIG. 24 is a cross-sectional view of the sealing assembly of FIG. 17 illustrating the cam drive for the sealing assembly.
Figure 25C:
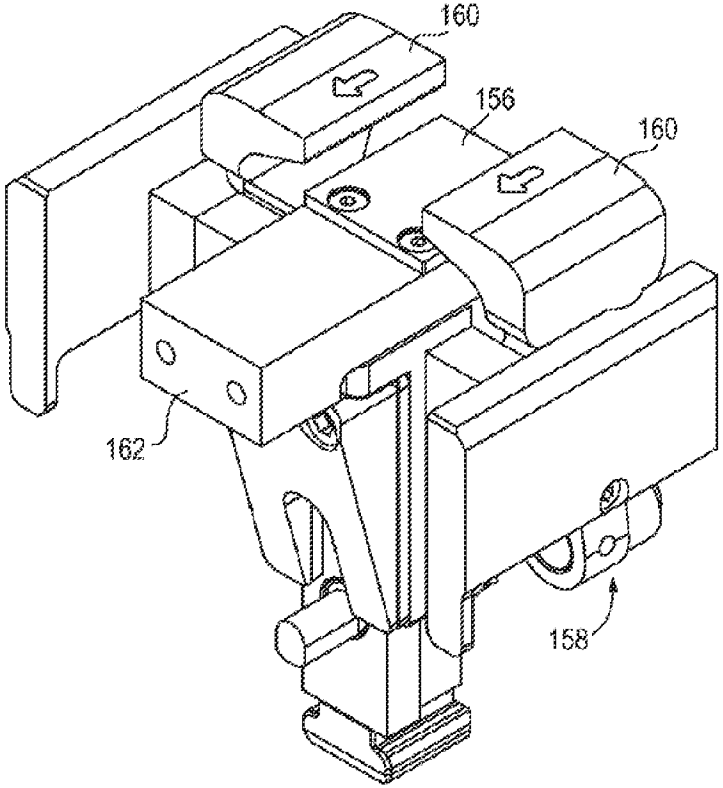
FIGS. 25*a*, 25*b*, 25*c*, and 25*d* are various illustrations of the trailing strap end grip and the carriage of the sealing assembly of FIG. 17.
Figure 25A:
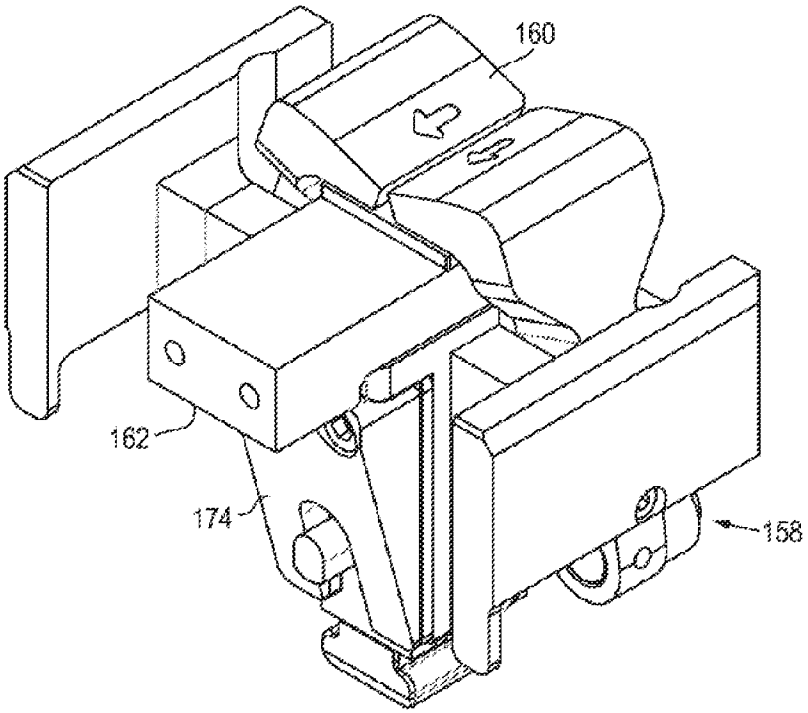
Figure 25D:
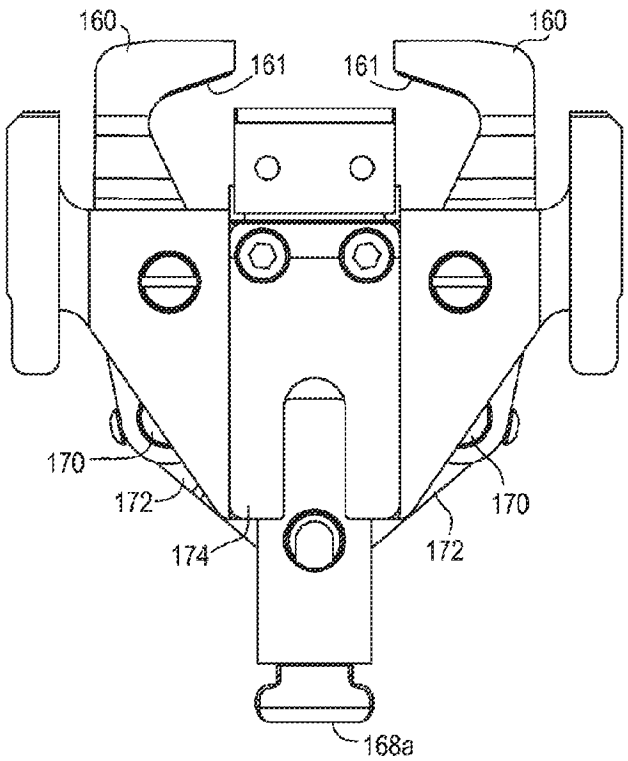
Figure 25B:
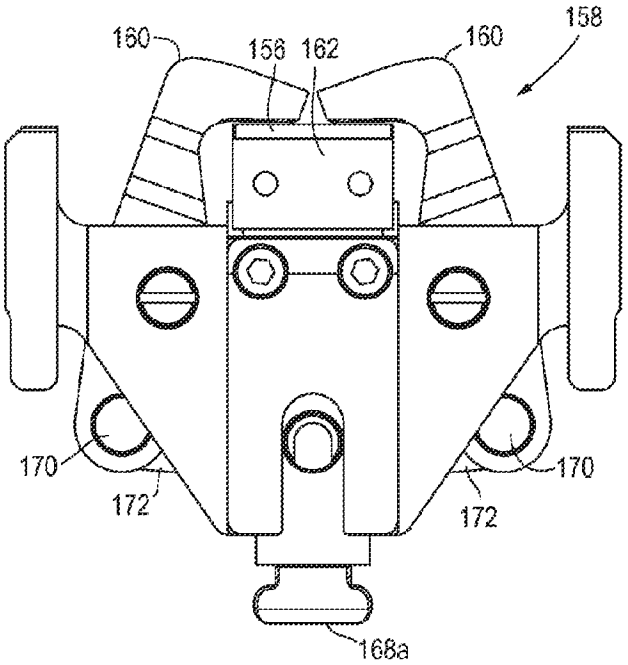
Figure 26B:
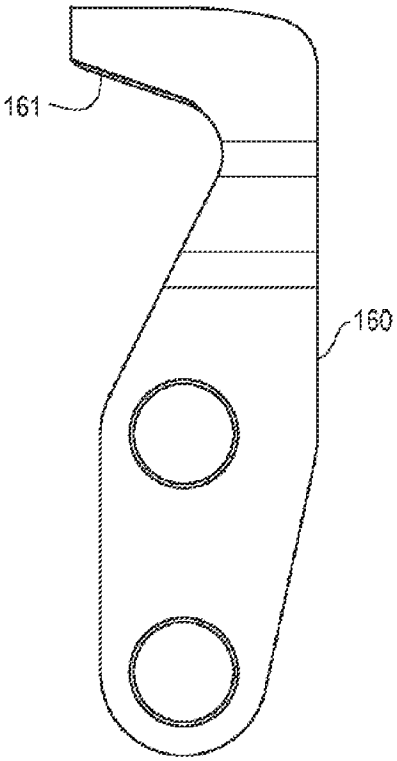
FIGS. 26*a* and 26*b* are perspective and side views of the trailing strap end grip jaws of the sealing assembly of FIG. 17.
Figure 26A:
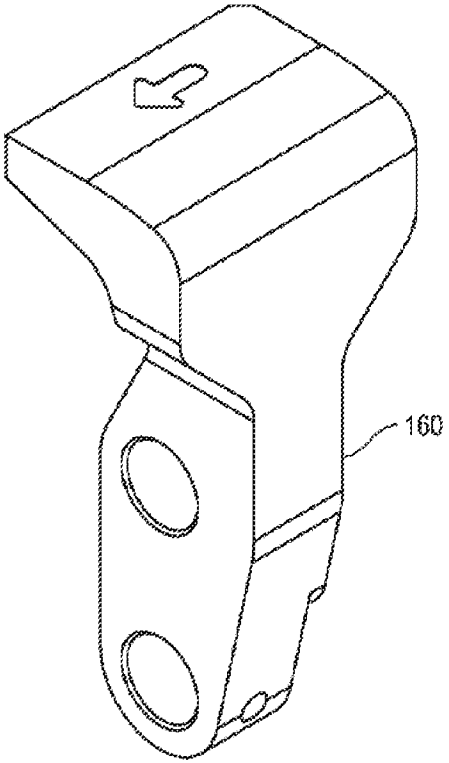
Figure 28:
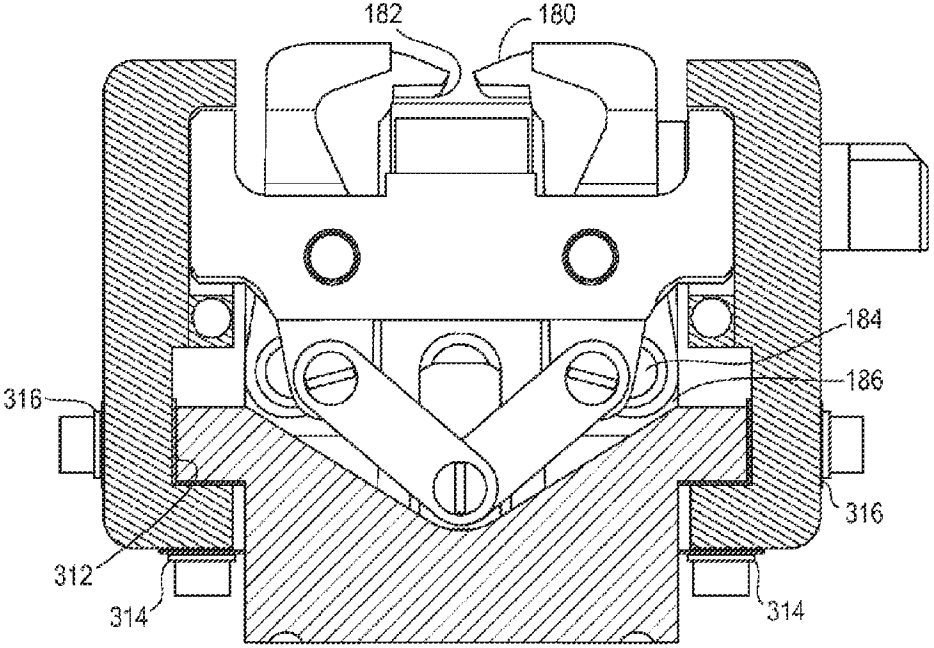
FIG. 28 is a cross-sectional view of the trailing strap end grip and the spacer jaws of the sealing assembly of FIG. 17.
Figure 27:
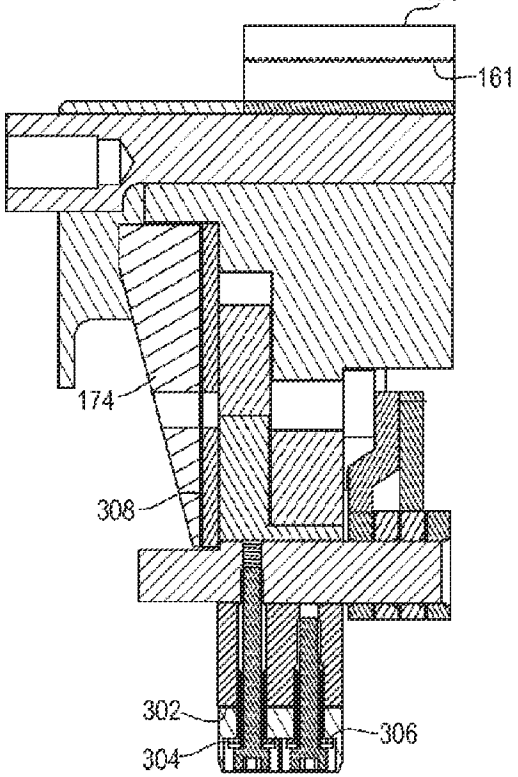
FIG. 27 is a side cross-sectional view of the trailing strap end grip carriage of the sealing assembly of FIG. 17 showing the inclined wedge.

To cause relative movement of the leading and trailing strap ends toward one another, the trailing strap end grip carriage 158 is longitudinally movable along (i.e., in the direction of) the strap path 92. Accordingly, as shown in FIG. 24, the carriage 158 includes an inclined or wedge surface 174 that cooperates with an actuating wedge element 176 actuated by the cam 94. As the actuating wedge 176 moves into contact with the wedge surface 174, the trailing strap end grip carriage 158 is urged toward the leading strap end grip 96 to move the trailing strap end toward the leading strap end for attachment. The actuating wedge 176 is also configured with a dual-acting cam 178 to provide positive, driven movement between the engaged and disengaged positions to positively drive the trailing strap end grip carriage 158 between the gripping and strap-attaching positions.

Figure 29:
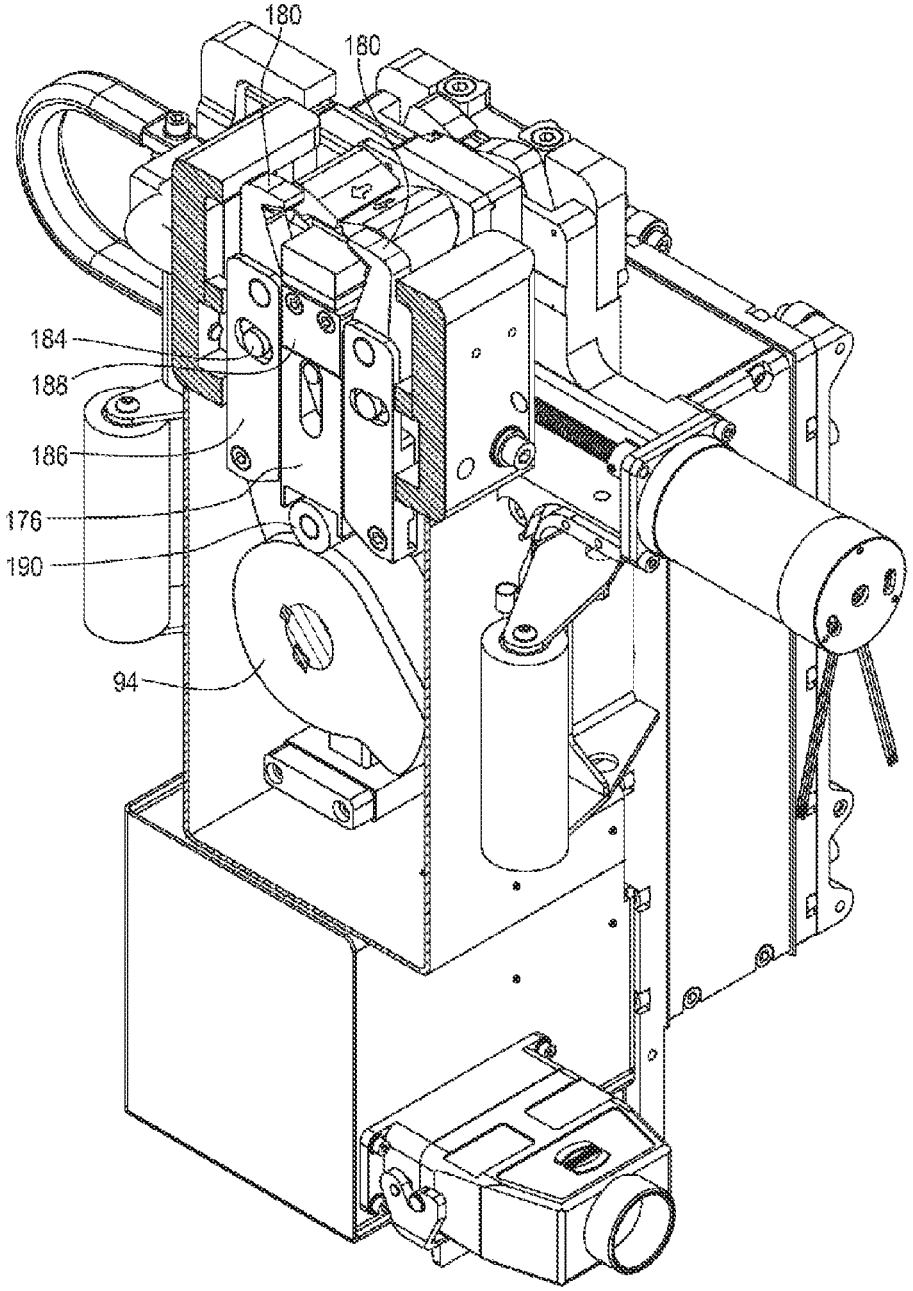
FIG. 29 is a cross-sectional view of the sealing assembly of FIG. 17 showing the spacer jaws.
Figure 30:
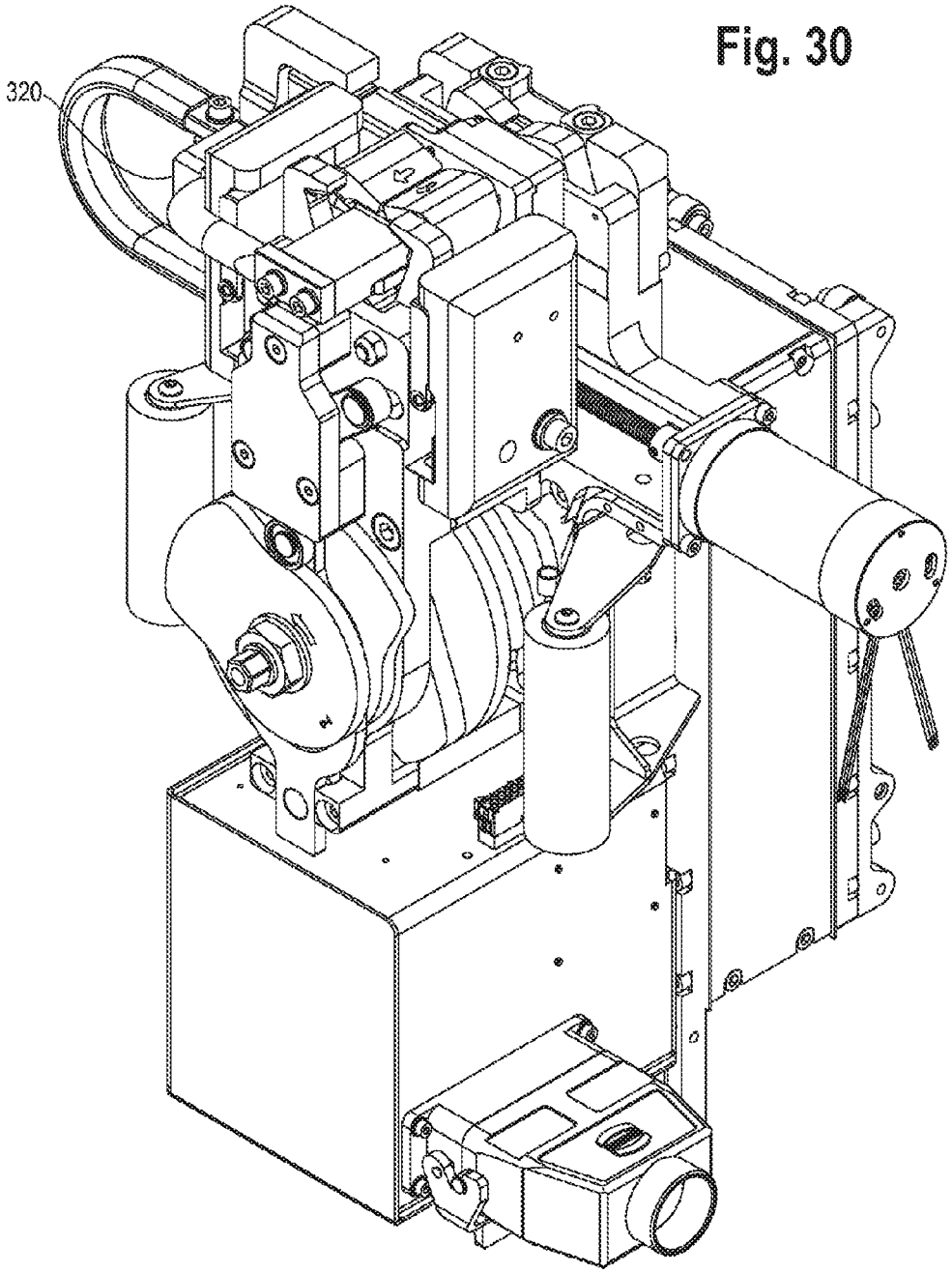
FIG. 30 is a perspective view of the sealing assembly of FIG. 17 illustrating one of the electrical contacts.
Figure 31:
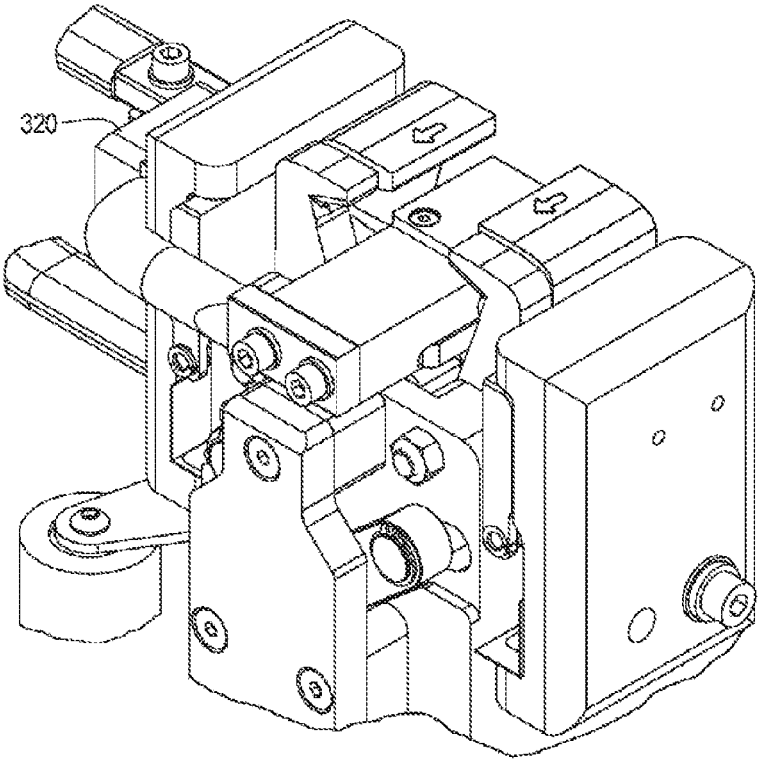
FIG. 31 is a partial perspective view of the sealing assembly of FIG. 17 illustrating one of the electrical contacts.
Figure 32:
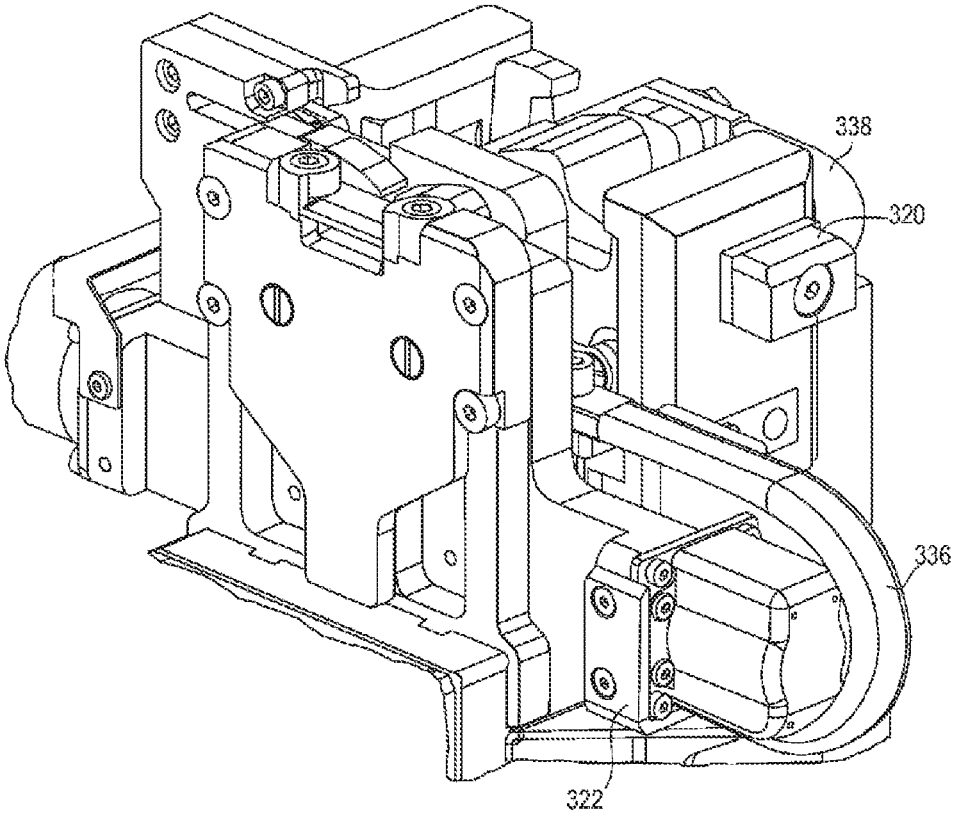
FIG. 32 is a perspective view of the sealing assembly of FIG. 17 showing the electrical contacts and their corresponding cables.
Figure 33:
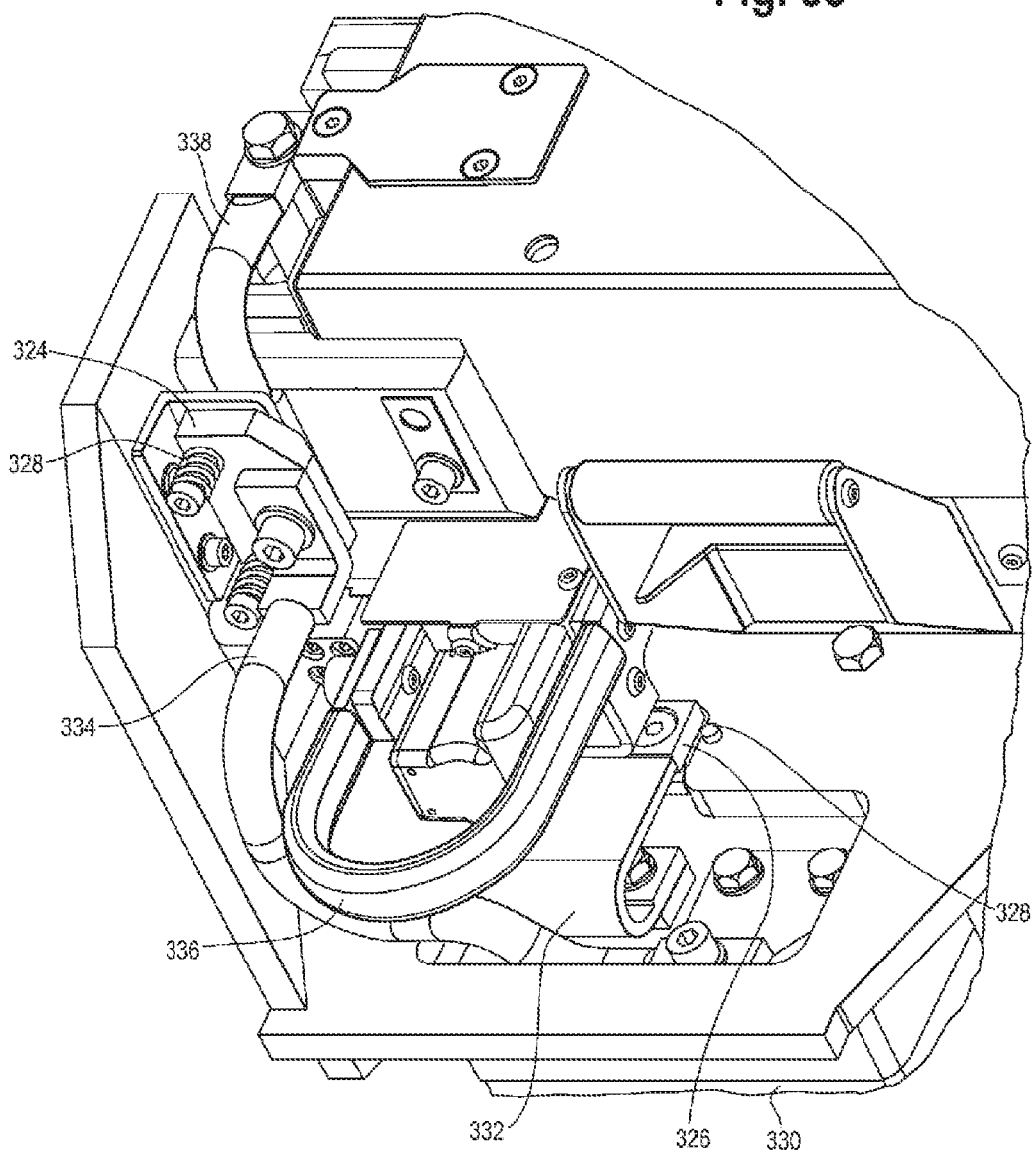
FIGS. 33 and 34 are fragmentary perspective views of the sealing assembly of FIG. 17 showing the electrical contacts and cables.
Figure 34:
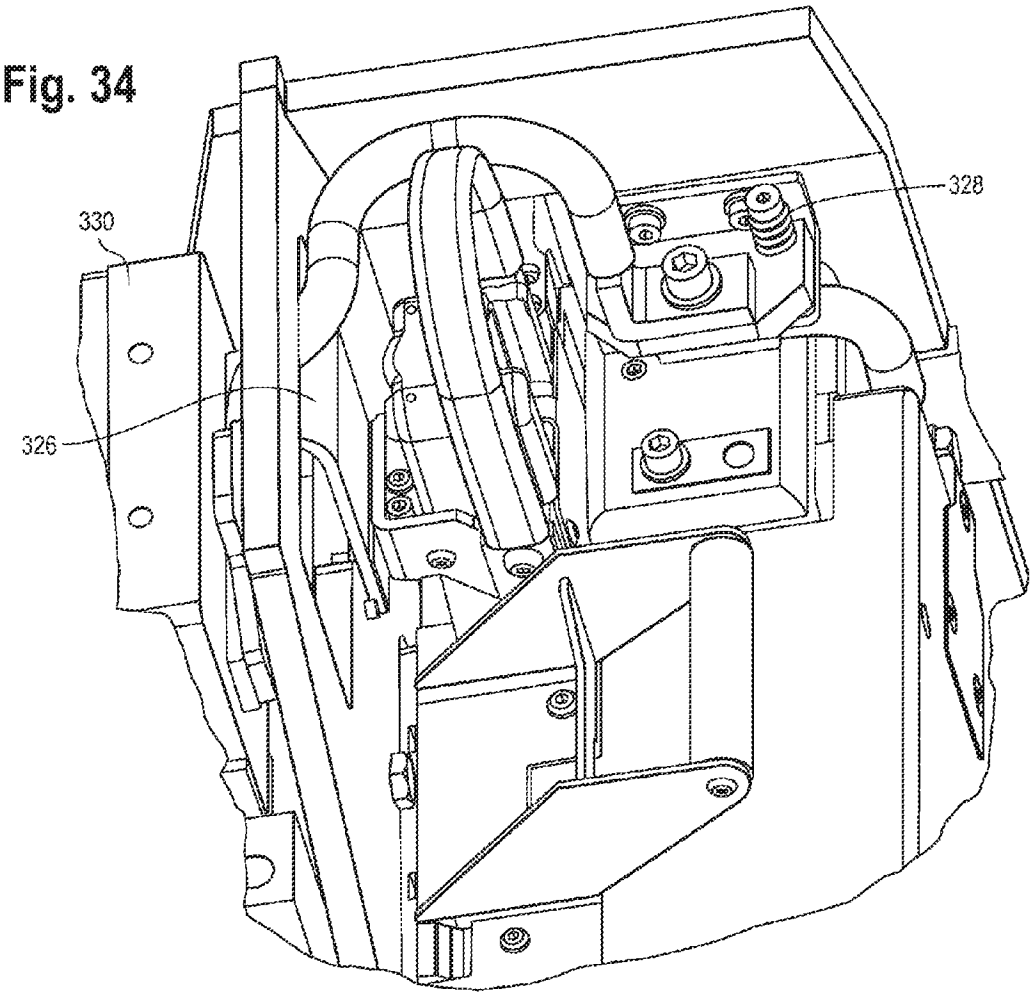
Figure 36:
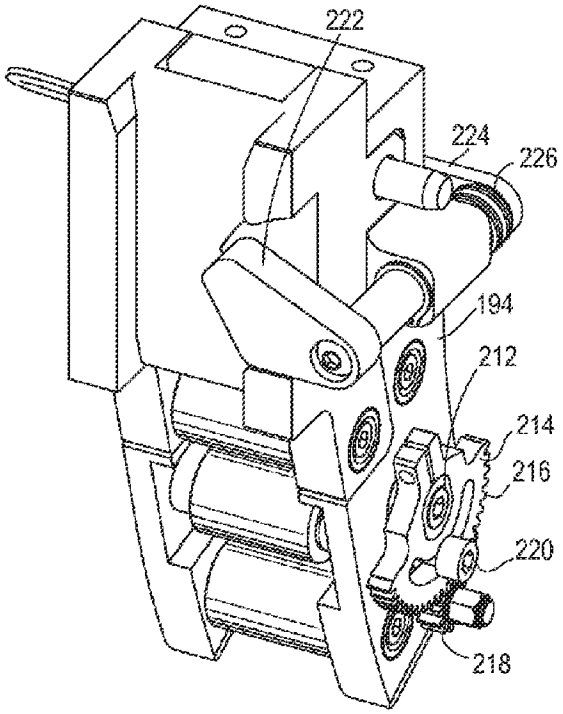
FIG. 36 is a perspective view of the strap straightener of FIG. 35.
Figure 35:
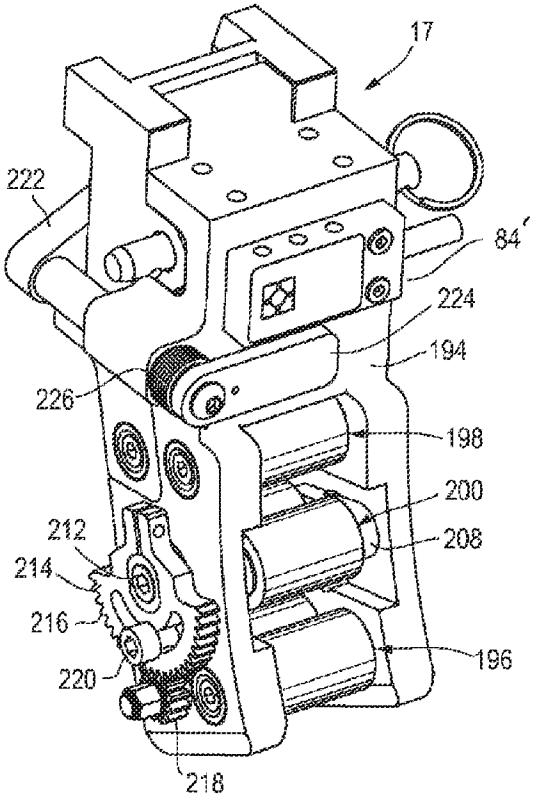
FIG. 35 is a perspective view of the strap straightener of the strapping machine of FIG. 1.
Figure 38:
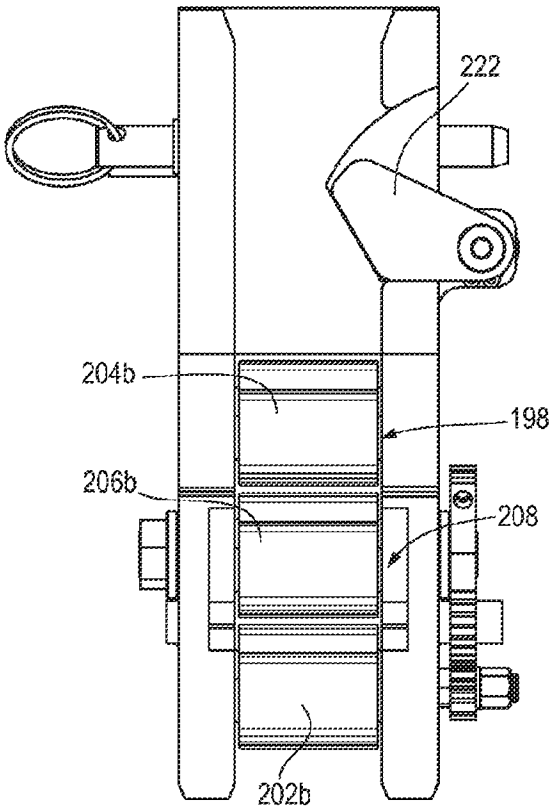
FIG. 38 is a side view of the strap straightener of FIG. 35.
Figure 37:
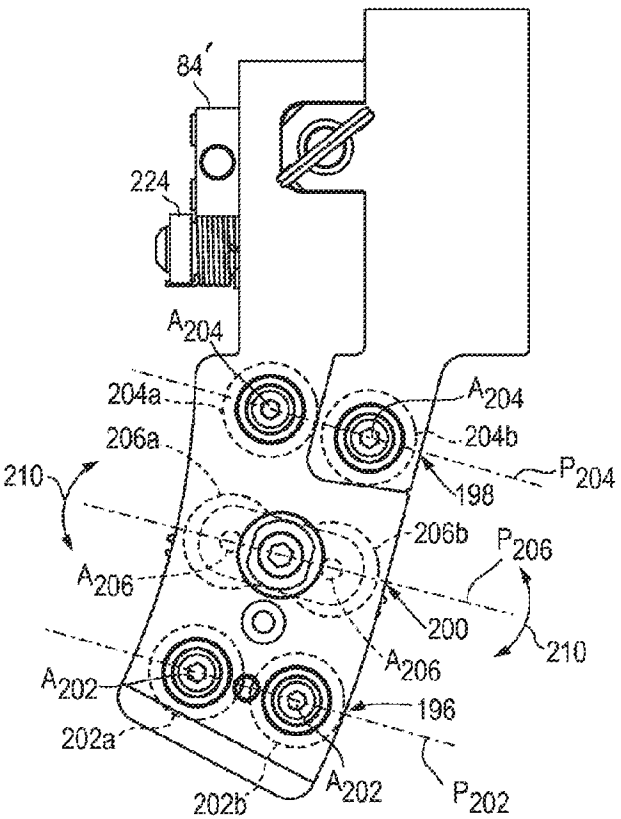
FIG. 37 is a front view of the strap straightener of FIG. 35.

As shown in FIGS. 24 and 29, a pair of spacer jaws 180 is adjacent to the trailing strap end grip jaws 160. The spacer jaws 180 serve to guide the strap S as it traverses through the sealing assembly 18. As such, the spacer jaws 180 do not bear down on the strap S when in the closed position, but instead define a gap 182 between the spacer jaws 180 and the trailing strap end grip clamp anvil 162. The spacer jaws 180 have a pivoting configuration similar to that of the trailing strap end grip jaws 160. Specifically, the spacer jaws 180 are pivotable about a pivot joint, such as the illustrated pivot pin 184. Link arms 186 extend from a lifter 188 mounted to a cam follower 190 to pivot the spacer jaws 180. As the lifter 188 moves upwardly (following the cam follower 190) toward (but not into the strap path 92), the link arms 186 pivot the base of the spacer jaws 180 outwardly, which in turn pivots the spacer jaws 180 inwardly toward the strap path 92.

To carry out the end-to-end weld of the loop and leading strap ends of the strap S, the sealing assembly 18 includes two electrodes 138 (FIGS. 20*a* to 20*e*) and 156 (FIGS. 25*a* to 25*d*). The leading strap end grip clamp anvil 134 (which grips the leading strap end) includes the electrode 138 and the trailing strap end grip clamp anvil 162 (which grips the trailing strap end) includes the electrode 156. The electrode 156 is electrically isolated from the sealing assembly 18 structure so that current is carried by (conducted through) the electrode 156. Isolation elements 302, 304, 306, 308, 310, 312, 314, 316, and 318 electrically isolate the trailing strap end grip electrode 156.

To enhance the modularity of the sealing assembly 18 and the strapping machine 10, connections to the sealing assembly electrodes 138 and 156 are of the quick-connect type. In this embodiment, as shown in FIGS. 30-34, there are two electrical contacts 320 and 322 on the sealing assembly 18. These are made of a highly conductive material to minimize resistance and surface area requirements. They are positioned such that, when the sealing assembly 18 is installed on the strapping machine 10, they nest with cooperating contacts 324 and 326 biased by spring 328. The contacts 324 and 326 are connected to a weld transformer 330 via a shunt 332 and a cable 334. A cable 338 connects the electrical contact 320 to the trailing strap end grip clamp anvil 162, and a cable 336 connects the electrical contact 322 to the leading strap end grip clamp 118.

The controller 22 includes a processing device communicatively connected to a memory device. The processing device may include any suitable processing device such as, but not limited to, a general-purpose processor, a special-purpose processor, a digital-signal processor, one or more microprocessors, one or more microprocessors in association with a digital-signal processor core, one or more application-specific integrated circuits, one or more field-programmable gate array circuits, one or more integrated circuits, and/or a state machine. The memory device may include any suitable memory device such as, but not limited to, read-only memory, random-access memory, one or more digital registers, cache memory, one or more semiconductor memory devices, magnetic media such as integrated hard disks and/or removable memory, magneto-optical media, and/or optical media. The memory device stores instructions executable by the processing device to control operation of the strapping machine 10 (such as to carry out a strapping cycle, as described below).

The controller 22 is communicatively connected to various sensors (such as the sensors 38, 71, and 81) to receive signals from these sensors. The controller 22 is communicatively and operably connected to the drives 24, 36, 76, 93, and 126 and the weld transformer 330 to receive signals from and control operation of these components to carry out the strapping cycle, as described below. The controller 22 is communicatively connected to an operator interface (not shown) to: (1) receive signals from the operator interface that represent inputs received by the operator interface; and (2) send signals to the operator interface to cause the operator interface to output (such as to display) information (such as information identifying the results of the strap-attachment check, as described below).

Figure 39:
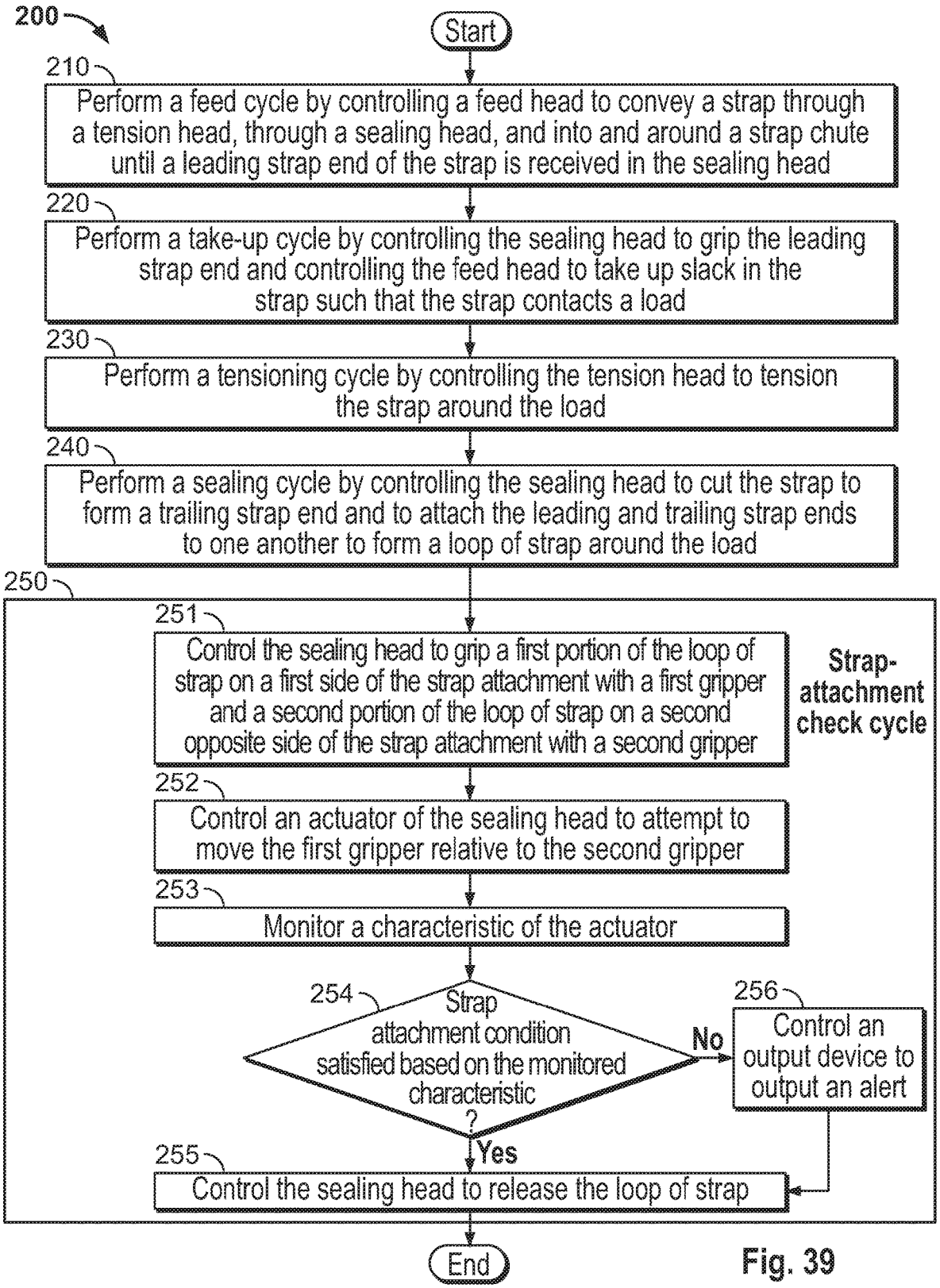
FIG. 39 is a flowchart illustrating an example method of operating the strapping machine of FIG. 1 to perform a strapping cycle including the strap-attachment check cycle.

FIG. 39 is a flowchart illustrating an example method 200 of operating a strapping device to perform a strapping cycle including the feed cycle, the take-up cycle, the tensioning cycle, the sealing cycle, and the strap-attachment check cycle. In other embodiments, the strapping device is not configured to carry out the feed cycle, the feed cycle and the take-up cycle, or one or more of the cycles.

Upon initiation of the strapping cycle (e.g., responsive to receipt of an appropriate operator input), the controller performs the feed cycle by controlling a feed assembly to convey a strap through a tension assembly, through a sealing assembly, and into and around a strap chute until a leading strap end of the strap is received by the sealing assembly, as block 210 indicates.

For example, for the strapping machine 10 described above, upon initiation of the strapping cycle, the controller 22 initiates the feed cycle and controls the feed assembly 14 to draw strap S from the strap supply and convey the strap S through the tension assembly 16 and the strap straightener 17 into the sealing assembly 18. As the sealing assembly 18 receives the leading strap end of the strap S, the leading strap end grip jaws 100 are open, the shuttle 116 is in the home position, the trailing strap end grip jaws 160 are open, and the spacer jaws 180 are open. The leading strap end grip clamp anvil 102, the leading strap end grip clamp anvil 134, and the trailing strap end grip clamp anvil 162 are in their respective retracted positions. The leading strap end passes through the sealing assembly 18 and traverses through the strap chute 20 and the feed limit assembly 74 and back into the sealing assembly 18. The feed limit assembly sensor 84 senses the leading strap end and signals the controller 22. The controller 22 controls the feed limit assembly drive 76 (if not already running) to urge the leading strap end into the sealing assembly 18. Once the leading strap end contacts and is stopped by the stop surface 152, the feed cycle is complete.

Returning to FIG. 39, after the feed cycle is complete, the controller performs the take-up cycle by controlling the sealing assembly to grip the leading strap end of the strap and controlling the feed assembly to take up slack in the strap such that the strap contacts a load, as block 220 indicates.

Returning to the example method of operating the strapping machine 10, the controller 22 initiates the take-up cycle and actuates the cam drive 93 to rotate the cam 94 to: (1) cause the leading strap end grip jaws 100 to close on the leading strap end and clamp it onto the leading strap end grip clamp anvil 102, and (2) cause the spacer jaws 180 to close over (but not contact) the strap S to form a guide for the strap S. The controller 22 controls the feed assembly 14 to operate in reverse to draw the strap S from chute 20 onto the load. This completes the take-up cycle.

Returning to FIG. 39, after the take-up cycle is complete, the controller performs the tensioning cycle by controlling the tension assembly to tension the strap around the load, as block 230 indicates.

Returning to the example method of operating the strapping machine 10, once the controller 22 determines that the strap S is on the load (for example, by determining that the feed assembly drive 24 stalled in the reverse direction), the controller 22 initiates the tensioning cycle and controls the tension assembly 16 to draw tension in the strap S. When a desired tension is reached, the controller 22 controls the tension assembly 16 to operate in brake mode to hold the strap S in tension. This concludes the tensioning cycle.

Returning to FIG. 39, after the tensioning cycle is complete, the controller performs the sealing cycle by controlling the sealing assembly to cut the strap to form a trailing strap end and to attach the leading and trailing strap ends of the strap to one another to form a loop of strap around the load, as block 240 indicates.

Returning to the example method of operating the strapping machine 10, the controller 22 initiates the sealing cycle and controls the cam drive 93 to further rotate the cam 94 to: (1) cause the trailing strap end grip jaws 160 to close on the strap S and to clamp it onto the trailing strap end grip clamp anvil 162, and (2) cause the spacer jaws 180 to open. The controller 22 turns off the tension assembly drive 36. The controller 22 controls the drive 126 to cause the shuttle 116 to move from the home position to the cut position and controls the cam drive 93 to further rotate the cam 94 to cause the cutter 128 to move from the home position to the cutting position to cut the strap S to form the trailing strap end. This cutting process creates a small gap (e.g., about 0.5 mm) between the leading and trailing strap ends. The controller 22 controls the cam drive 93 to further rotate the cam 94 to cause the cutter 128 to move back to the retracted position. The strap S is now ready for welding.

The controller 22 controls the drive 126 to cause the shuttle 116 to move to the strap-attaching position, thereby causing the leading strap end grip clamp 118 to slide over the leading strap end of the strap S. The controller 22 controls the cam drive 93 to further rotate the cam 94 to cause the leading strap end grip clamp anvil 134 to move up to clamp the leading strap end of the strap S between the contact surface 146 of the leading strap end grip clamp 118 and the electrode 138 on the leading strap end grip clamp anvil 134.

The controller 22 turns the weld transformer 330 on and controls the cam drive 93 to further rotate the cam 94 to cause the wedge element 176 to begin moving upwardly to engage the wedge surface 174 (on the carriage 158), thereby causing the trailing strap end grip carriage 158 (which grips the trailing strap end) to move longitudinally along the strap path 92 toward the leading strap end grip 96 and the leading strap end. For about half of the longitudinal movement, the carriage 158 moves slowly as the leading and trailing strap ends are heated via current conducted through the electrodes 138 and 156. For about the second half of the longitudinal movement, the controller 22 turns the weld transformer 330 off and controls the cam drive 93 to further rotate the cam 94 at a relatively faster rate to cause the trailing strap end grip carriage 158 to move the heated trailing strap end of the strap S relatively quickly into the leading strap end to fuse the ends to one another at an attachment area. The overall movement of the trailing strap end grip carriage 158 is about 6 mm over about 2 seconds. The end-to-end weld is completed upon completion of the movement of the trailing strap end grip carriage 158. Since the sealing assembly 18 welds the leading and trailing strap ends to one another in an end-to-end manner, the strap ends (which have been cut from the strap supply) do not have any of the typical coating materials on their surfaces. Accordingly, unlike known strap welding techniques, there is no need to prepare or otherwise treat the leading and trailing strap end surfaces before welding.

Returning to FIG. 39, after the sealing cycle is complete, the controller performs the strap-attachment check cycle, as block 250 indicates. Specifically, the controller controls the sealing assembly to grip a first portion of the strap loop on a first side of the strap attachment with a first gripper and a second portion of the strap loop on a second opposite side of the strap attachment with a second gripper, as block 251 indicates. In some embodiments, the first gripper and/or the second gripper already grip the first portion and/or the second portion of the strap loop upon completion of the sealing cycle. In these embodiments, the controller controls the sealing assembly to continue gripping the strap via the first and second grippers. The controller controls an actuator of the sealing assembly to attempt to move the first gripper relative to the second gripper, as block 252 indicates. The controller monitors a characteristic of the actuator, as block 253 indicates. The controller determines whether a strap-attachment condition is satisfied based on the monitored characteristic, as diamond 254 indicates. More particularly, the controller determines whether the strength of the strap attachment meets or exceeds a desired minimum threshold.

If the controller determines at diamond 254 that the strap-attachment condition is satisfied (such as the strap attachment strength meeting or exceeding a desired minimum threshold) based on the monitored characteristic, the controller determines that the strap attachment is satisfactory and controls the sealing assembly to release the strap loop, as block 255 indicates. In certain embodiments, the controller also controls one or more output devices to output a visual confirmation (e.g., controls a display screen to display an indication or activates a light), an audio confirmation (e.g., controls a speaker to output a sound), or both.

If the controller determines at diamond 254 that the strap-attachment condition is not satisfied based on the monitored characteristic, the controller controls one or more output devices to output a visual alert (e.g., controls a display screen to display an indication or activates a light), an audio alert (e.g., controls a speaker to output a sound), or both, as block 256 indicates, and controls the sealing assembly to release the strap loop, as block 255 indicates.

Figure 40:
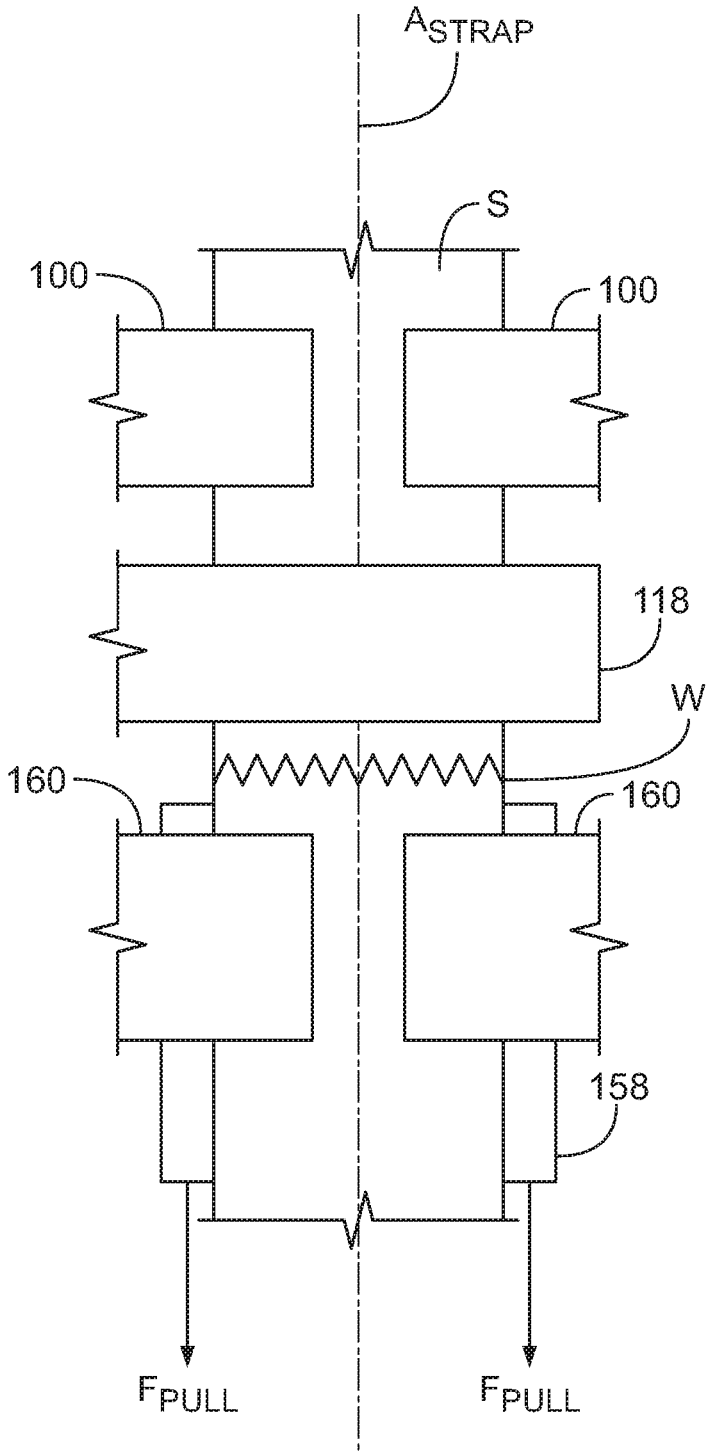
FIG. 40 is a schematic view of a portion of the sealing assembly during the strap-attachment check cycle.

Returning to the example method of operating the strapping machine 10, after a predetermined period of time elapses following completion of the strap-attachment cycle, the controller 22 initiates the strap-attachment check cycle. At this point, as best shown in FIG. 40: (1) the trailing strap end grip jaws 160 (the first gripper in this example) grip the strap S against the trailing strap end grip clamp anvil 162 (not shown in FIG. 40) on one side of the strap attachment W (the former trailing strap end side); and (2) the leading strap end grip jaws 100 (the second gripper in this example) grip the strap S against the leading strap end grip clamp anvil 102 (not shown in FIG. 40) and the leading strap end grip clamp anvil 134 (not shown in FIG. 40) grips the strap S against the contact surface 146 (not shown in FIG. 40) of the leading strap end grip clamp 118 on the other side of the attachment W (the former leading strap end side).

To test the strength of the strap attachment, the controller 22 controls the cam drive 93 (the actuator in this example) to rotate the cam 94 (for instance, in a direction opposite the previously-described directions) to attempt to move the carriage 158 away from the leading strap end grip clamp 118 and the leading strap end grip 96. This causes the trailing strap end grip jaws 160 to impose a pulling force $F_{PULL}$ on the portion of the strap S between the trailing strap end grip jaws 160 and the leading strap end grip clamp 118. $F_{PULL}$ is parallel to the longitudinal axis of the strap $A_{STRAP}$. The magnitude of the force $F_{PULL}$ varies depending on the type of strap (e.g., steel or plastic) and the manner of attachment (e.g., end-to-end weld or friction weld). In various embodiments, the magnitude of the force $F_{PULL}$ is a percentage (such as 50% to 100%) of the minimum strength expected for that particular manner of attachment for that particular type of strap.

As this occurs, the controller 22 monitors the cam drive 93 to determine whether a stall condition is satisfied (e.g., monitors a stall characteristic of the cam drive 93). In this embodiment, the strap-attachment condition is satisfied when the stall condition is satisfied upon expiration of a designated period of time following initiation of the strap-attachment check cycle, and the strap-attachment condition is not satisfied when the stall condition is not satisfied upon expiration of the designated period of time following initiation of the strap-attachment check cycle.

The controller 22 may determine whether the stall condition is satisfied in any suitable manner. In one embodiment, the controller 22 monitors feedback received from an encoder of the cam drive 93 from which the controller 22 can derive rotational speed of the shaft of the cam drive 93 and rotational position of the shaft of the cam drive 93. In certain embodiments, the controller 22 determines that the stall condition is satisfied if the rotational speed of the shaft of the cam drive 93 is below a certain threshold rotational speed for a certain period of time. In other embodiments, the controller 22 determines that the stall condition is satisfied if the rotational position of the shaft of the cam drive 93 changes less than a designated amount during a certain period of time. In other embodiments, the controller 22 determines that the stall condition is satisfied if the back-electromotive force of the cam drive 93 is below a certain threshold back-electromotive force upon expiration of a certain period of time.

If the controller 22 determines that the strap-attachment condition is not satisfied (in this embodiment, that the stall condition is not satisfied upon expiration of the designated period of time following initiation of the strap-attachment check cycle), the controller 22 controls a speaker (an output device) to output an alarm tone and a light (another output device) to activate. This alerts the operator that the strap attachment is unsatisfactory. In other embodiments, the strapping machine includes a video screen configured to display an alarm indicator responsive to the controller determining that the strap-attachment condition is not satisfied.

After determining whether the strap-attachment condition is satisfied, the controller 22 controls the cam drive 93 to further rotate the cam 94 to cause the leading strap end grip clamp anvil 102 to move away from the leading strap end grip jaws 100, to cause the leading strap end grip jaws 100 to open and to enable the spring 136 to return the leading strap end grip clamp anvil 134 to the retracted position. The controller 22 controls the drive 126 to move the shuttle 116 to the home position. The controller 22 controls the cam drive 93 to further rotate the cam 94 to cause the trailing strap end grip clamp anvil 162 to move away from the trailing strap end grip jaws 160 and to cause the trailing strap end grip jaws 160 to open. This releases the strap loop. The controller 22 controls the cam drive 93 to further rotate the cam 94 to cause the carriage 158 to move away from the shuttle 116. As soon as the strap loop is released, the strapped load can then be moved or removed from the strapping machine 10, which is ready for another strapping cycle.

The various cycles described above are merely examples, and other embodiment may include cycles with different, fewer, or additional steps than those described above. Although the strap-attachment check cycle is described above with respect to the example strapping machine 10, this is merely one non-limiting example embodiment. The strap-attachment check cycle and functionality may be employed by any suitable strapping machine, strapping tool, or other strapping device configured for use with strap of any suitable material (such as plastic or steel).

In certain embodiments, the controller is configured to control the second gripper to attempt to move relative to the first gripper instead of or in addition to controlling the first gripper to attempt to move relative to the second gripper. More generally, the controller is configured to control the first gripper and/or the second gripper to attempt to move away from one another.

The grippers may be any suitable components, such as wheels or external grippers driven by a cam, power screws, or rack-and-pinion devices. The grippers may be configured as toothed pads on self-energizing mechanisms or as jaws (as in the above-described embodiment) that may have teeth. The grippers may include spring-loaded components biased into contact with the strap.

In certain embodiments, responsive to the determining that the strap-attachment condition is not satisfied, the controller is configured to shut the strapping machine down or enter a standby mode rather than (or in addition to) causing the output device to output an alert. In various embodiments, the controller is configured to prevent the operator from starting another strapping cycle until receiving an input acknowledging that the operator is aware that the strap-attachment condition was not satisfied (such as receiving an input via a touch screen).

Thus, in various embodiments, a strapping machine comprises a sealing assembly and a controller. The controller is configured to control the sealing assembly to attach a first end of a strap and a second end of a strap to one another at an attachment area and, afterwards, grip a first portion of the strap and impose a force on a second portion of the strap in a direction away from the first portion of the strap, wherein the first and second portions of the strap are on opposite sides of the attachment area.

In one such embodiment, the sealing assembly further comprises an actuator, and the controller is configured to control the actuator to impose the force on the second portion of the strap.

In another such embodiment, the sealing assembly further comprises a first gripper and a second gripper, and the controller is configured to control the first gripper to grip the first portion of the strap, to control the second gripper to grip the second portion of the strap, and to control the actuator to impose the force on the second portion of the strap by controlling the actuator to attempt to move the first gripper relative to the second gripper.

In another such embodiment, the force is aligned with a longitudinal axis of the strap.

In another such embodiment, the actuator is further configured to send feedback associated with a characteristic of the actuator to the controller.

In another such embodiment, the controller is configured to determine, based on the feedback, whether a strap-attachment condition is satisfied.

In another such embodiment, the controller is configured to determine that the strap attachment is satisfactory responsive to determining that the strap-attachment condition is satisfied, and that the strap attachment is unsatisfactory responsive to determining that the strap-attachment condition is not satisfied.

In another such embodiment, the strapping machine further comprises an output device. The controller is further configured to control the output device to output an indication responsive to determining that the strap-attachment condition is not satisfied.

In another such embodiment, the indication comprises at least one of an audible alarm and a visual alarm.

In another such embodiment, the strapping machine further comprises an output device. The controller is further configured to control the output device to output a confirmation responsive to determining that the strap-attachment condition is satisfied.

In another such embodiment, the confirmation comprises at least one of an audible confirmation and a visual confirmation.

In another such embodiment, the actuator comprises a motor, the characteristic is a stall characteristic, and the controller is configured to determine that the strap-attachment condition is satisfied if the motor stalls within a designated time period, and to determine that the strap-attachment condition is not satisfied if the motor does not stall within the designated time period.

In another such embodiment, the controller is configured to determine whether a strap-attachment condition associated with the attachment area is satisfied.

In another such embodiment, the controller is configured to cause at least one of a visual indication and an audio indication of whether the strap-attachment condition is satisfied or not.

In various embodiments, a method of operating a strapping machine comprises controlling, by a controller, a sealing assembly to attach a first end of a strap and a second end of a strap to one another at an attachment area; and afterwards, controlling, by the controller, the sealing assembly to grip a first portion of the strap and impose a force on a second portion of the strap in a direction away from the first portion of the strap, wherein the first and second portions of the strap are on opposite sides of the attachment area.

In one such embodiment, the method further comprises controlling, by the controller, an actuator to impose the force on the second portion of the strap.

In another such embodiment, the method further comprises controlling, by the controller, a first gripper to grip the first portion of the strap; controlling, by the controller, a second gripper to grip the second portion of the strap; and controlling, by the controller, the actuator to impose the force on the second portion of the strap by controlling the actuator to attempt to move the first gripper relative to the second gripper.

In another such embodiment, the force is aligned with a longitudinal axis of the strap.

In another such embodiment, the method further comprises sending, by the actuator, feedback associated with a characteristic of the actuator to the controller.

In another such embodiment, the method further comprises determining, by the controller and based on the feedback, whether a strap-attachment condition is satisfied.

In another such embodiment, the method further comprises determining, by the controller, that the strap attachment is satisfactory responsive to determining that the strap-attachment condition is satisfied, and that the strap attachment is unsatisfactory responsive to determining that the strap-attachment condition is not satisfied.

In another such embodiment, the method further comprises controlling, by the controller, an output device to output an indication responsive to determining that the strap-attachment condition is not satisfied.

In another such embodiment, the indication comprises at least one of an audible alarm and a visual alarm.

In another such embodiment, the method further comprises controlling, by the controller, an output device to output a confirmation responsive to determining that the strap-attachment condition is satisfied.

In another such embodiment, the confirmation comprises at least one of an audible confirmation and a visual confirmation.

In another such embodiment, the actuator comprises a motor, wherein the characteristic is a stall characteristic, and the method further comprises determining, by the controller, that the strap-attachment condition is satisfied if the motor stalls within a designated time period and determining, by the controller, that the strap-attachment condition is not satisfied if the motor does not stall within the designated time period.

In another such embodiment, the method includes determining, by the controller, whether a strap-attachment condition associated with the attachment is satisfied.

In another such embodiment, the method includes causing, by the controller, at least one of a visual indication and an audio indication of whether the strap-attachment condition is satisfied or not.

The invention claimed is:

1. A strapping device comprising:

a sealing assembly comprising a first gripper and an actuator; and a controller configured to:

cause the sealing assembly to attach a leading strap end of a strap and a trailing strap end of the strap to one another at an attachment area to form a tensioned strap loop around a load; and after the leading and trailing strap ends are attached to one another and after the first gripper grips a first portion of the strap that forms the tensioned strap loop, control the actuator to cause the first gripper to impose a force on the first portion of the strap in a direction away from a second portion of the strap that forms the tensioned strap loop, wherein at least one component of the direction is aligned with a longitudinal axis of the strap, wherein the first and second portions of the strap are on opposite sides of the attachment area.

2. The strapping device of claim 1, wherein the actuator is configured to send feedback associated with a characteristic of the actuator to the controller.

3. The strapping device of claim 2, wherein the controller is further configured to determine, based on the feedback, whether a strap-attachment condition is satisfied.

4. The strapping device of claim 3, further comprising an output device, wherein the controller is further configured to control the output device to output an indication responsive to determining that the strap-attachment condition is not satisfied.

5. The strapping device of claim 3, wherein the actuator comprises a motor, the characteristic is a stall characteristic, the strap-attachment condition is satisfied if the motor stalled within a designated time period, and the strap-attachment condition is not satisfied if the motor did not stall within the designated time period.

6. The strapping device of claim 1, wherein the sealing assembly comprises a second gripper, wherein the controller is further configured to control the actuator to cause the first gripper to grip the first portion of the strap before causing the sealing assembly to attach the leading and trailing strap ends to one another, to cause the second gripper to grip the second portion of the strap, and then to cause the first gripper to impose the force on the first portion of the strap.

7. The strapping device of claim 6, wherein the controller is further configured to control the actuator to cause the first gripper to impose the force on the first portion of the strap by controlling the actuator to attempt to move the first gripper away from the second gripper.

8. A method of operating a strapping device, the method comprising:

controlling, by a controller, a sealing assembly to attach a leading strap end of a strap and a trailing strap end of the strap to one another at an attachment area to form a tensioned strap loop around a load;

after the leading and trailing strap ends are attached toone another; and after a first gripper of the sealing assembly grips a first portion of the strap that forms the tensioned strap loop, controlling, by the controller, the actuator of the sealing assembly to cause the first gripper to impose a force on the first portion of the strap in a direction away from a second portion of the strap that forms the tensioned strap loop, wherein at least one component of the direction is aligned with a longitudinal axis of the strap, wherein the first andsecond portions of the strap are on opposite sides of the attachment area.

9. The method of claim 8, further comprising sending, by the actuator, feedback associated with a characteristic of the actuator to the controller.

10. The method of claim 9, further comprising determining, by the controller and based on the feedback, whether a strap-attachment condition is satisfied.

11. The method of claim 10, further comprising controlling, by the controller and responsive to determining that the strap-attachment condition is not satisfied, an output device to output an indication.

12. The method of claim 10, wherein the actuator comprises a motor, wherein the characteristic is a stall characteristic, wherein the strap-attachment condition is satisfied if the motor stalled within a designated time period, and wherein the strap-attachment condition is not satisfied if that the motor did not stall within the designated time period.

13. The method of claim 8, further controlling, by the controller, the actuator to cause the first gripper to grip the first portion of the strap before controlling the sealing assembly to attach the leading and trailing strap ends to one another, to cause a second gripper to grip the second portion of the strap, and then to cause the first gripper to impose the force on the second portion of the strap.

14. The method of claim 13, further comprising controlling, by the controller, the actuator to cause the first gripper to impose the force on the second portion of the strap by controlling the actuator to attempt to move the first gripper away from the second gripper.

* * * * *